US009052668B2

(12) United States Patent
Masuda et al.

(10) Patent No.: US 9,052,668 B2
(45) Date of Patent: Jun. 9, 2015

(54) IMAGE FORMING APPARATUS, SENSING METHOD, AND RECORDING MEDIUM

(71) Applicants: Koji Masuda, Kanagawa (JP); Susumu Momma, Kanagawa (JP); Hidemasa Suzuki, Kanagawa (JP)

(72) Inventors: Koji Masuda, Kanagawa (JP); Susumu Momma, Kanagawa (JP); Hidemasa Suzuki, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/164,552

(22) Filed: Jan. 27, 2014

(65) Prior Publication Data

US 2014/0219670 A1 Aug. 7, 2014

(30) Foreign Application Priority Data

Feb. 5, 2013 (JP) ..... 2013-020015

(51) Int. Cl.

*G03G 21/00* (2006.01)
*G03G 15/20* (2006.01)
*G03G 15/00* (2006.01)

(52) U.S. Cl.

CPC ..... *G03G 15/55* (2013.01); *G03G 15/2014* (2013.01); *G03G 2215/2032* (2013.01)

(58) Field of Classification Search

CPC ..... G03G 15/55; G01B 11/303; G01B 11/306
USPC ..... 356/600
See application file for complete search history.

(56) References Cited

U.S. PATENT DOCUMENTS 5,488,476 A * 1/1996 Mansfield et al. ..... 356/512
5,970,181 A * 10/1999 Ohtsu ..... 382/274
6,922,263 B2 * 7/2005 Sone ..... 358/461
8,606,130 B2 12/2013 Suzuki et al.
2009/0238590 A1 9/2009 Masuda
2010/0008686 A1 1/2010 Masuda et al.
2010/0266302 A1 10/2010 Suzuki et al.
2010/0310284 A1 12/2010 Funato et al.
2011/0043810 A1 2/2011 Suzuki et al.
2011/0044713 A1 2/2011 Masuda et al.
2012/0268750 A1 10/2012 Masuda
2013/0208285 A1 * 8/2013 Miettinen et al. ..... 356/600
2013/0216267 A1 8/2013 Masuda et al.
2013/0243446 A1 9/2013 Masuda
2013/0243458 A1 9/2013 Suzuki et al.
2013/0308966 A1 11/2013 Masuda et al.

FOREIGN PATENT DOCUMENTS

JP 5-113739 5/1993
JP 2002-318160 10/2002
JP 2006-251165 9/2006
JP 2008-134334 6/2008
JP 2009-139527 6/2009
JP 2010-190685 9/2010
JP 2013-242399 12/2013
JP 2014-59442 4/2014

* cited by examiner

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

An image forming apparatus comprises: a sensor that includes a light-emitting part for emitting light to a moving body and a light-receiving part; a light-incidence adjusting mechanism that is able to alternatively select from a first state where the light-incidence adjusting mechanism causes light which have been emitted from the sensor and then reflected by the moving body to enter the sensor and a second state where the light-incidence adjusting mechanism causes a reflected light of light emitted from the sensor not to enter the sensor; and a processing unit that causes the sensor to emit light, and corrects output of the sensor when the light-incidence adjusting mechanism is in the first state on the basis of output of the sensor when the light-incidence adjusting mechanism is in the second state.

9 Claims, 30 Drawing Sheets

IMAGE FORMING APPARATUS, SENSING METHOD, AND RECORDING MEDIUM

CROSS-REFERENCE TO RELATED APPLICATIONS

The present application claims priority to and incorporates by reference the entire contents of Japanese Patent Application No. 2013-020015 filed in Japan on Feb. 5, 2013.

BACKGROUND OF THE INVENTION

1. Field of the Invention

The present invention relates to an image forming apparatus, a sensing method, and a recording medium, and more particularly, to an image forming apparatus including a moving body, a sensing method using a sensor that receives light reflected from an object, and a computer-readable recording medium storing therein a program used in an apparatus equipped with a sensor that receives light reflected from an object.

2. Description of the Related Art

An image forming apparatus typically includes a photosensitive drum and a charging device, an exposure device, and a developing device, etc. which are arranged around the photosensitive drum. The surface of the photosensitive drum is uniformly charged by the charging device, and the charged portion is exposed to a laser light emitted from the exposure device. As a result, an electrostatic latent image is formed on the photosensitive drum, and this electrostatic latent image is developed into a toner image by the developing device.

The toner image on the photosensitive drum is transferred onto a sheet conveyed on a conveyance belt. The sheet onto which the toner image has been transferred is detached from the conveyance belt, and is conveyed to a fixing device, and then after toner is fixed on the sheet by the fixing device, the sheet is discharged from the image forming apparatus.

The fixing device includes a fixing belt for applying heat and pressure to a sheet. For example, in an image forming apparatus available for A4 and A3-size sheets, when the fixing is repeatedly performed on A4-size sheets fed in portrait orientation, longitudinal streak-like abrasions may occur on portions of the surface of the fixing belt corresponding to the positions where the both ends of the A4-size sheets in a sheet width direction have passed. This is because the surface of the fixing belt is roughened by burrs at the edges of the sheets and paper dust.

At this time, when an A4-size sheet in landscape orientation or an A3-size sheet in portrait orientation is fed, so-called gloss streaks corresponding to the longitudinal streak-like abrasions appear on the surface of an image formed on the sheet, and the image quality is deteriorated. Consequently, an image forming apparatus capable of detecting a surface condition of a fixing member has been invented (for example, see Japanese Patent Application Laid-open No. 05-113739 and Japanese Patent No. 4632820).

Demands for the image quality on image forming apparatuses are increasing every year. However, image forming apparatuses disclosed in Japanese Patent Application Laid-open No. 05-113739 and Japanese Patent No. 4632820 have difficulty in stably detecting a surface condition of a fixing member with high accuracy, and may cause deterioration in the image quality.

SUMMARY OF THE INVENTION

It is an object of the present invention to at least partially solve the problems in the conventional technology.

According to the present invention, there is provided an image forming apparatus comprising: a sensor configured to include a light-emitting part for emitting light to a moving body and a light-receiving part; a light-incidence adjusting mechanism configured to be able to alternatively select from a first state where the light-incidence adjusting mechanism causes light which have been emitted from the sensor and then reflected by the moving body to enter the sensor and a second state where the light-incidence adjusting mechanism causes a reflected light of light emitted from the sensor not to enter the sensor; and a processing unit configured to cause the sensor to emit light, and correct output of the sensor when the light-incidence adjusting mechanism is in the first state on the basis of output of the sensor when the light-incidence adjusting mechanism is in the second state.

The present invention also provides a sensing method using a sensor that includes a light-emitting part for emitting light to an object and a light-receiving part, a portion of the light emitted when the light-emitting part is turned on being scattered within the sensor and received by the light-receiving part, the sensing method comprising: causing light which have been emitted from the sensor and then reflected by the object to enter the sensor and finding output of the sensor as a first output value; causing the sensor to emit light and finding output of the sensor as a second output value, in a state where a reflected light of light emitted from the sensor does not enter the sensor; correcting the first output value on the basis of the second output value; and finding surface information of the object on the basis of the corrected first output value.

The present invention also provides a non-transitory computer-readable recording medium that contains a computer program used in an apparatus equipped with a sensor that includes a light-emitting part for emitting light to an object and a light-receiving part, a portion of the light emitted when the light-emitting part is turned on being scattered within the sensor and received by the light-receiving part, the program causing a computer for controlling the apparatus to execute: causing light which have been emitted from the sensor and then reflected by the object to enter the sensor and finding output of the sensor as a first output value; causing the sensor to emit light and finding output of the sensor as a second output value, in a state where a reflected light of light emitted from the sensor does not enter the sensor; correcting the first output value on the basis of the second output value; and finding surface information of the object on the basis of the corrected first output value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
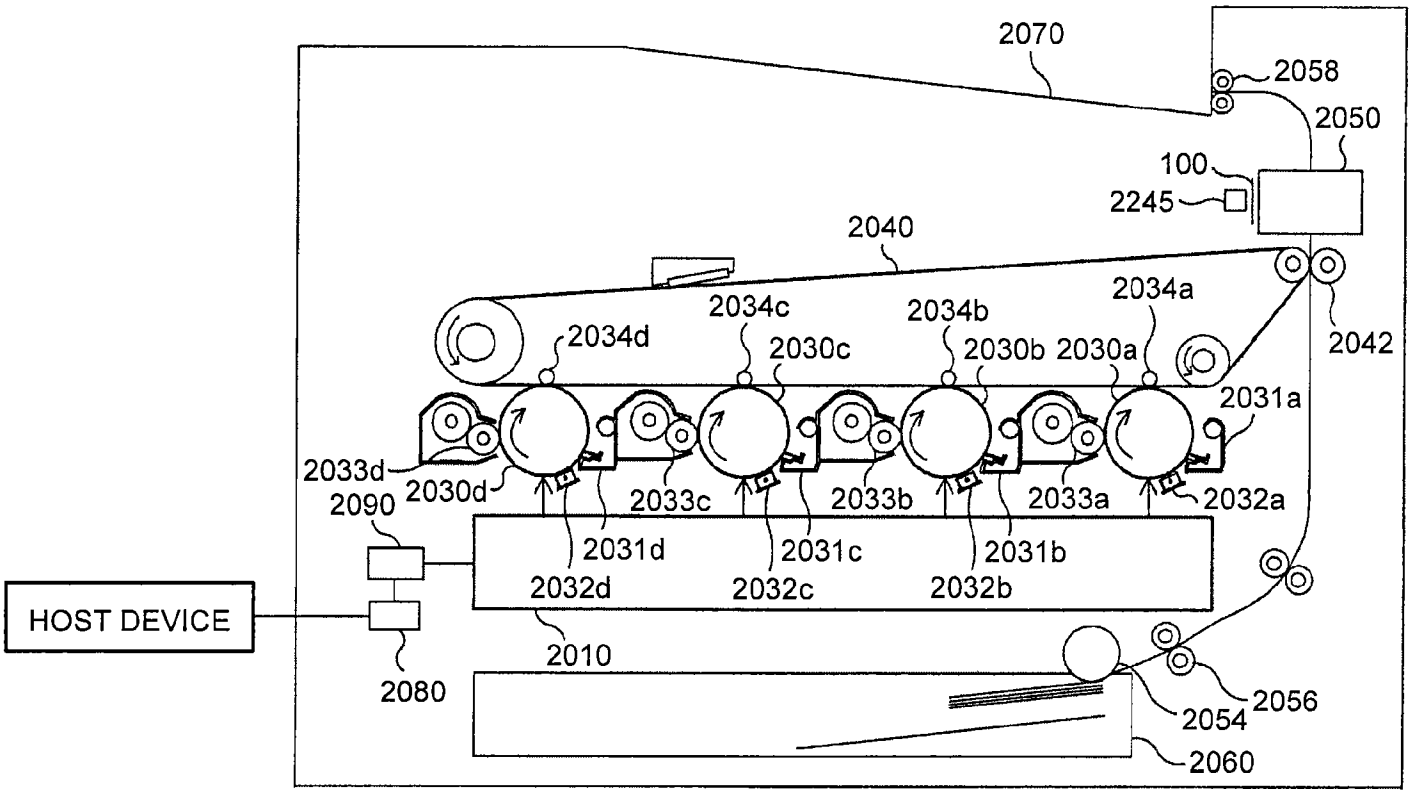
FIG. 1 is a diagram for explaining a schematic configuration of a color printer according to an embodiment of the present invention.

An embodiment of the present invention will be explained below on the basis of FIGS. 1 to 32. FIG. 1 shows a schematic configuration of a color printer 2000 according to the embodiment.

This color printer 2000 is a tandem-type multicolor printer that forms a full-color image by superimposing four different color images (black, cyan, magenta, and yellow images) on top of one another, and includes an optical scanning device 2010, four photosensitive drums (2030*a*, 2030*b*, 2030*c*, 2030*d*), four cleaning units (2031*a*, 2031*b*, 2031*c*, 2031*d*), four charging devices (2032*a*, 2032*b*, 2032*c*, 2032*d*), four developing rollers (2033*a*, 2033*b*, 2033*c*, 2033*d*), four transfer rollers (2034*a*, 2034*b*, 2034*c*, 2034*d*), an intermediate transfer belt 2040, a secondary transfer roller 2042, a fixing device 2050, a sheet feed roller 2054, a pair of conveyance rollers 2056, a sheet discharge roller 2058, a sheet feed tray 2060, a copy receiving tray 2070, a communication control device 2080, a reflective optical sensor 2245, a light blocking mechanism 100, an operation panel (not shown), and a printer control device 2090 for controlling the above-mentioned units overall, etc.

The communication control device 2080 controls two-way communication between the color printer 2000 and a host device (for example, a personal computer) via a network.

The printer control device 2090 includes a CPU, a ROM in which a program written in code that the CPU can read and various data used at the time of execution of the program have been stored, a RAM used as a working memory, an amplifier circuit, and an A/D conversion circuit for converting an analog signal into a digital signal, etc. Then, the printer control device 2090 notifies the optical scanning device 2010 of multicolor image information (black image information, cyan image information, magenta image information, and yellow image information) received from the host device via the communication control device 2080.

The operation panel includes multiple keys through which an operator makes various settings and a display for displaying thereon a variety of information.

The photosensitive drum 2030*a*, the charging device 2032*a*, the developing roller 2033*a*, the transfer roller 2034*a*, and the cleaning unit 2031*a* are used as a set, and compose an image forming station for forming a black image (hereinafter, also referred to as a "K station" for convenience sake).

The photosensitive drum 2030*b*, the charging device 2032*b*, the developing roller 2033*b*, the transfer roller 2034*b*, and the cleaning unit 2031*b* are used as a set, and compose an image forming station for forming a cyan image (hereinafter, also referred to as a "C station" for convenience sake).

The photosensitive drum 2030*c*, the charging device 2032*c*, the developing roller 2033*c*, the transfer roller 2034*c*, and the cleaning unit 2031*c* are used as a set, and compose an image forming station for forming a magenta image (hereinafter, also referred to as an "M station" for convenience sake).

The photosensitive drum 2030*d*, the charging device 2032*d*, the developing roller 2033*d*, the transfer roller 2034*d*, and the cleaning unit 2031*d* are used as a set, and compose an image forming station for forming a yellow image (hereinafter, also referred to as a "Y station" for convenience sake).

A photosensitive layer is formed on the surface of each photosensitive drum. Here, the surface of each photosensitive drum is a scanned surface. Each of the photosensitive drums rotates in a direction indicated by arrowed line in the plane in FIG. 1 by means of a rotation mechanism (not shown).

Each of the charging devices uniformly charges the surface of a corresponding photosensitive drum.

The optical scanning device 2010 scans the charged surface of a corresponding photosensitive drum with light modulated for each color on the basis of the multicolor image information from the printer control device 2090. As a result, a latent image corresponding to image information is formed on the surface of the photosensitive drum. The formed latent image moves in a direction of a corresponding developing roller in accordance with the rotation of the photosensitive drum.

Toner supplied from a corresponding toner cartridge (not shown) is thinly and evenly applied to the surface of the developing roller in accordance with the rotation of the developing roller. Then, when the developing roller comes in contact with the surface of the corresponding photosensitive drum, the toner on the surface of the developing roller is transferred and attached to only a portion of the surface of the photosensitive drum exposed to the light. Namely, each developing roller transfers toner to a latent image formed on the surface of a corresponding photosensitive drum, thereby developing the latent image into a toner image. The toner image moves in a direction of the intermediate transfer belt 2040 in accordance with the rotation of the photosensitive drum.

Each of the transfer rollers transfers a toner image to the intermediate transfer belt 2040.

Yellow, magenta, cyan, and black toner images are sequentially transferred onto the intermediate transfer belt 2040 at predetermined timings so as to be superimposed on top of one another, thereby a color image is formed on the intermediate transfer belt 2040.

The sheet feed tray 2060 contains recording sheets. The sheet feed roller 2054 is placed near the sheet feed tray 2060, and picks up a recording sheet from the sheet feed tray 2060 one by one. The recording sheet is fed, by the pair of conveyance rollers 2056, into a gap between the intermediate transfer belt 2040 and the secondary transfer roller 2042 at predetermined timing. And, the toner image on the intermediate transfer belt 2040 is transferred onto the recording sheet. The recording sheet onto which the toner image has been transferred is conveyed to the fixing device 2050.

In the fixing device 2050, heat and pressure are applied to the recording sheet, thereby the toner is fixed on the recording sheet. The recording sheet on which the toner has been fixed is conveyed to the copy receiving tray 2070 through the sheet discharge roller 2058, and is stacked on the copy receiving tray 2070 in sequence.

Each of the cleaning units removes toner (residual toner) remaining on the surface of a corresponding photosensitive drum. The surface of the photosensitive drum from which the residual toner has been removed goes back to the position opposed to a corresponding charging device.

The reflective optical sensor 2245 is placed near the fixing device 2050. Details of this reflective optical sensor 2245 will be described later.

Figure 2:
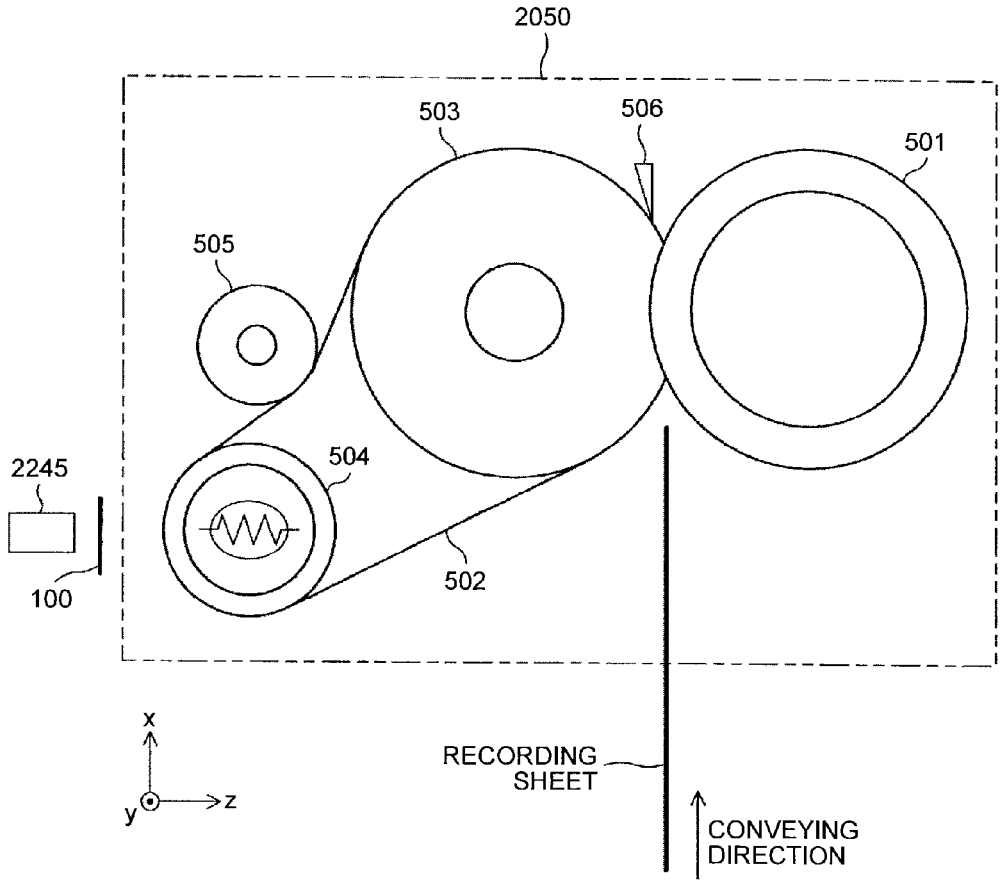
FIG. 2 is a diagram for explaining a fixing device.

The fixing device 2050 includes, for example, a pressure roller 501, a fixing belt 502, a fixing roller 503, a heat roller 504, a tension roller 505, a separation claw 506, and a temperature sensor (not shown), etc. as shown in FIG. 2.

Here, a direction perpendicular to the plane of a recording sheet conveyed to the fixing device 2050 is denoted by an z-axis direction in an xyz three-dimensional orthogonal coordinate system. Furthermore, a conveying direction of the recording sheet is denoted by a +x direction.

The pressure roller 501 is one that a metal core bar, such as aluminum or iron core bar, is covered with an elastic member such as silicon rubber, and then coated with fluorine resin.

The fixing belt 502 is one that base material, such as nickel or polyimide, is coated with fluorine resin. Incidentally, an elastic member such as silicon rubber can be added between the base material and the fluorine resin.

The fixing belt 502 is a loop belt supported by the fixing roller 503 and the heat roller 504, and is maintained at appropriate tension by the tension roller 505.

The fixing roller 503 is one that a metal core bar, such as aluminum or iron core bar, is covered with silicon rubber.

The heat roller 504 is an aluminum or iron hollow roller, and has a heat source, such as a halogen heater, inside the hollow roller.

The tension roller 505 is one that a metal core bar, such as aluminum or iron core bar, is covered with silicon rubber.

Multiple separation claws 506 are installed along a direction parallel to the rotation axis of the fixing roller 503 (a y-axis direction). The respective tips of the separation claws 506 are in contact with the surface of the fixing roller 503.

The temperature sensor detects the temperature of the fixing belt 502 on the heat roller 504 without contact with the fixing belt 502. Incidentally, a contact-type temperature sensor can be used as the temperature sensor.

In this fixing device 2050, when a recording sheet goes into a nip part formed between the fixing roller 503 and the pressure roller 501, predetermined pressure and heat are applied to the recording sheet at the nip part, and a toner image is fixed on the recording sheet.

Figure 3:
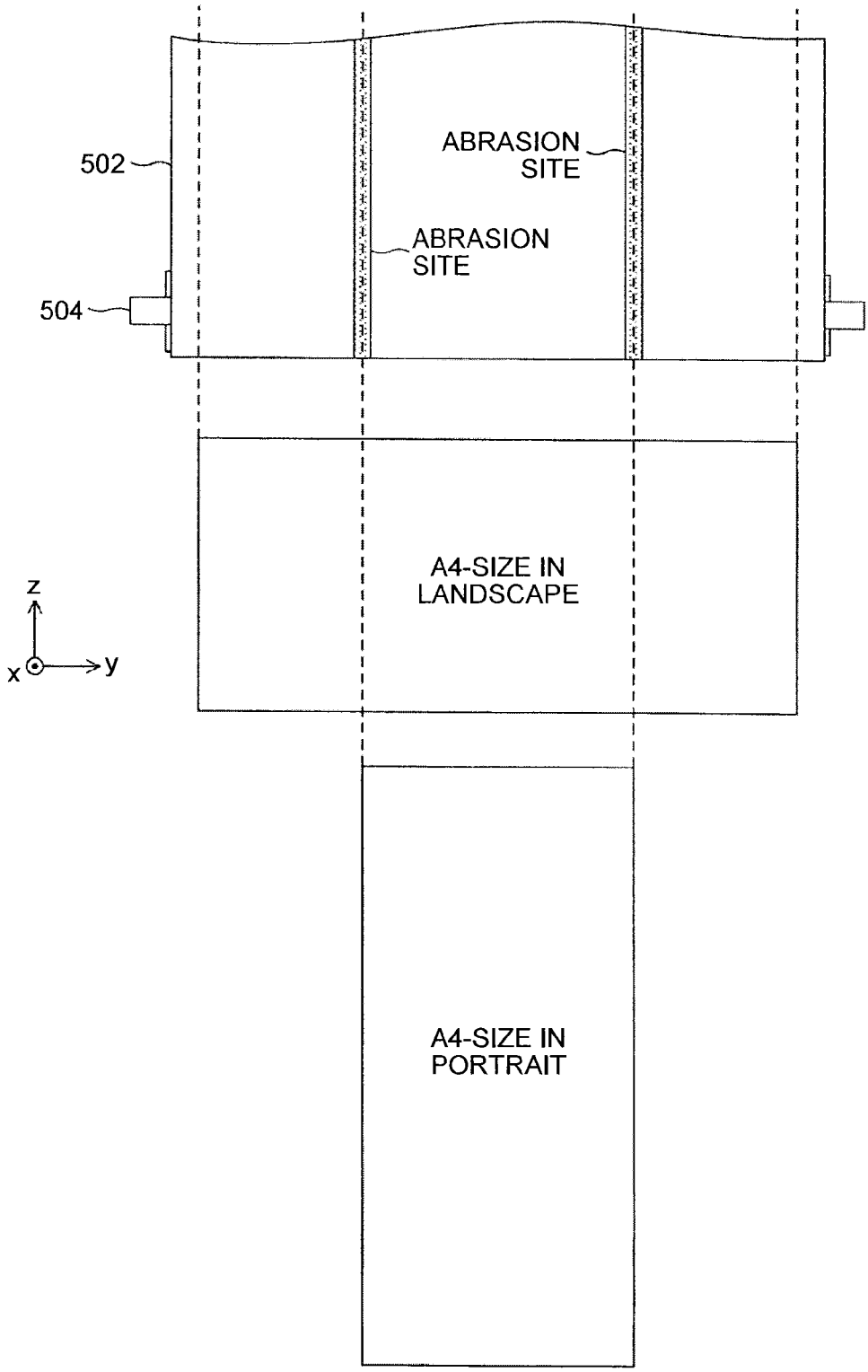
FIG. 3 is a diagram for explaining sites of occurrence of abrasions on a fixing belt.
Figure 4:
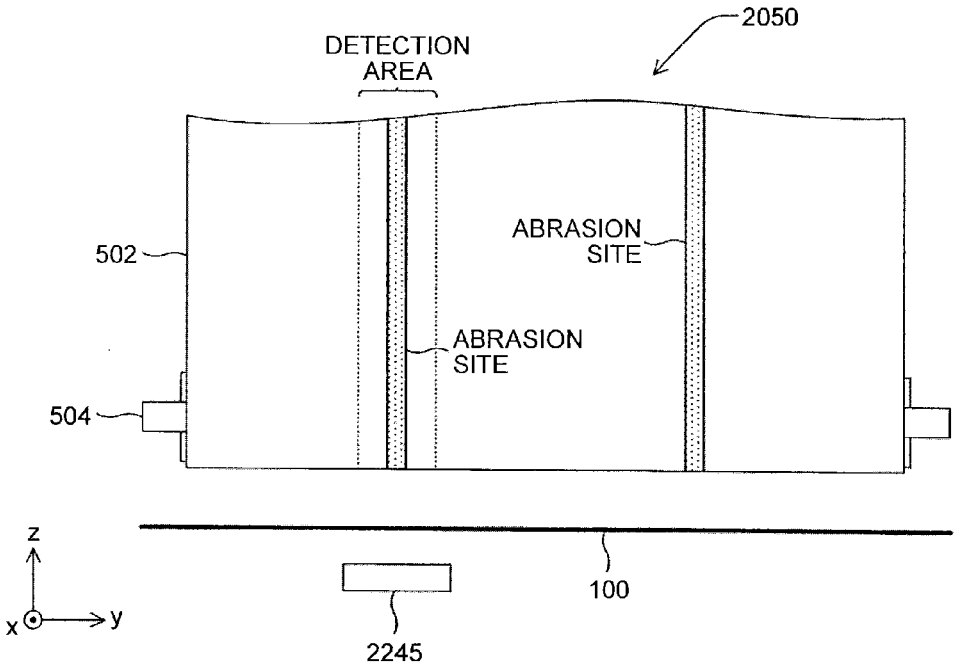
FIG. 4 is a diagram for explaining the placement position of a reflective optical sensor.
Figure 5:
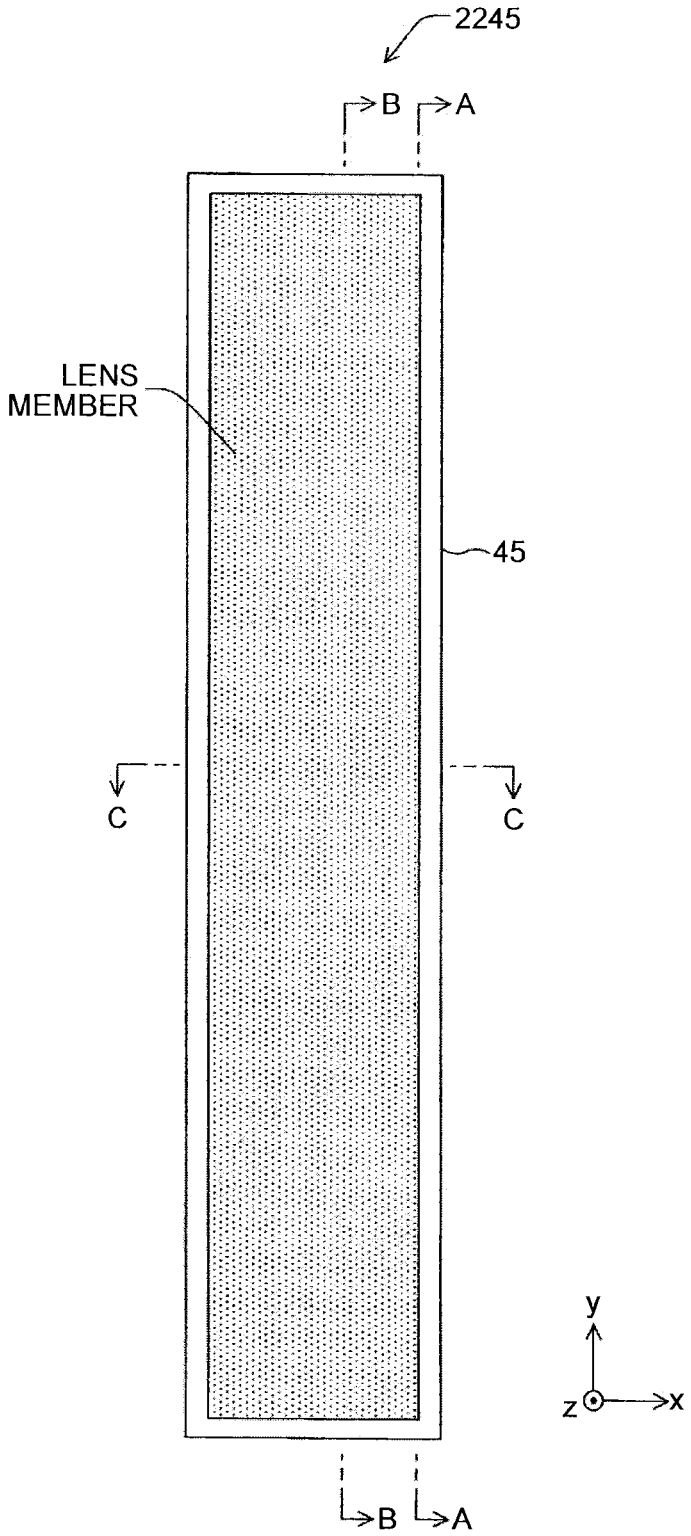
FIG. 5 is a (first) diagram for explaining the reflective optical sensor.

In this fixing device 2050, when the fixing is repeatedly performed on A4-size recording sheets in portrait orientation, longitudinal streak-like abrasions may occur on portions of the surface of the fixing belt 502 corresponding to the positions where the both ends of the recording sheets in a width direction have passed (see FIG. 3). This is because the surface of the fixing belt 502 is roughened by burrs at the edges of the recording sheets and paper dust. A fixing belt having a high degree of surface hardness particularly tends to scar easily.

At this time, when an A4 recording sheet in landscape orientation or an A3 recording sheet in portrait orientation is fed, so-called gloss streaks corresponding to the abrasions appear on the surface of an image, and the image quality is deteriorated.

Consequently, to detect positions of the abrasions on the fixing belt 502 and conditions of the abrasions (depths of the abrasions, widths of the abrasions), the reflective optical sensor 2245 is placed near the fixing device 2050.

Here, the reflective optical sensor 2245 is placed on the −z side of the fixing device 2050. As for the y-axis direction, the reflective optical sensor 2245 is placed in the position opposed to one of sites of occurrence of the abrasions (hereinafter, referred to as "abrasion site(s)") on the fixing belt 502 (see FIG. 4). Incidentally, in FIG. 4, the reflective optical sensor 2245 is placed in the position opposed to a −y side abrasion site out of two abrasion sites; alternatively, the reflective optical sensor 2245 can be placed in the position opposed to a +y side abrasion site.

Figure 6:
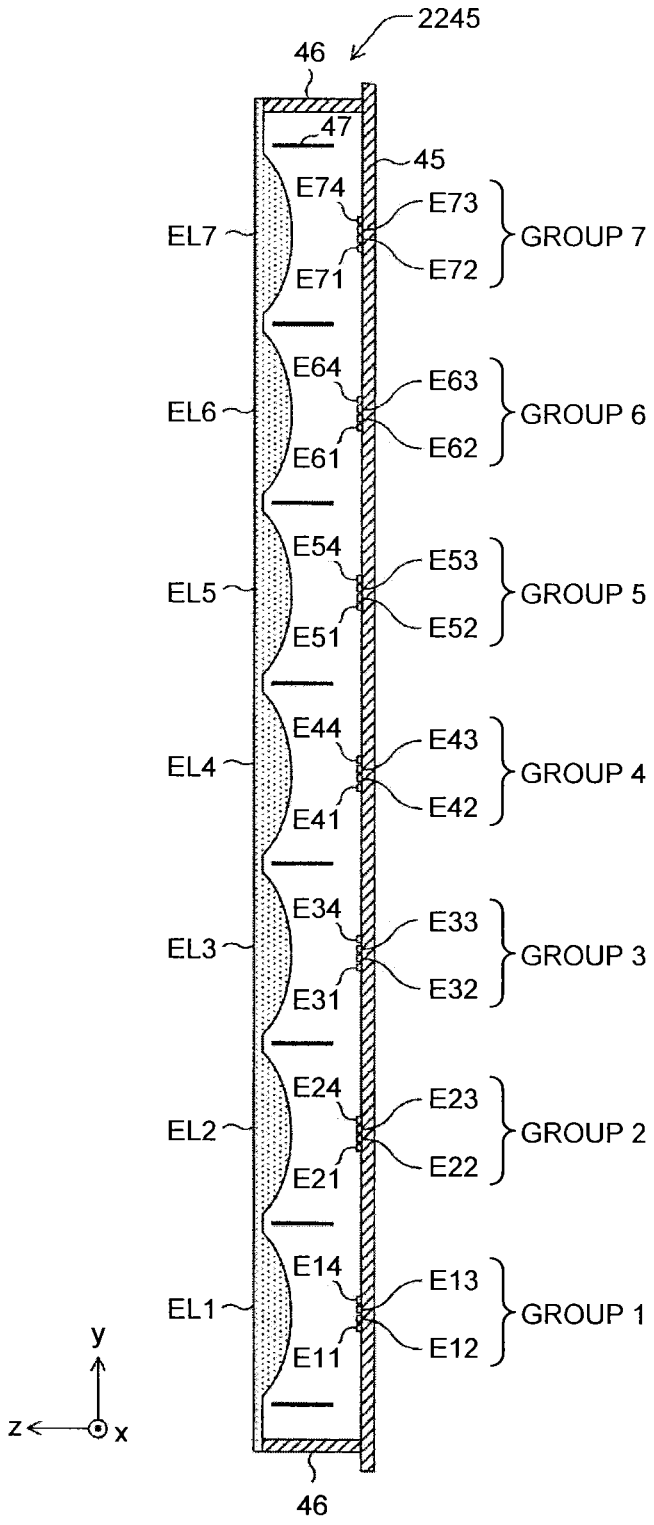
FIG. 6 is a (second) diagram for explaining the reflective optical sensor.
Figure 7:
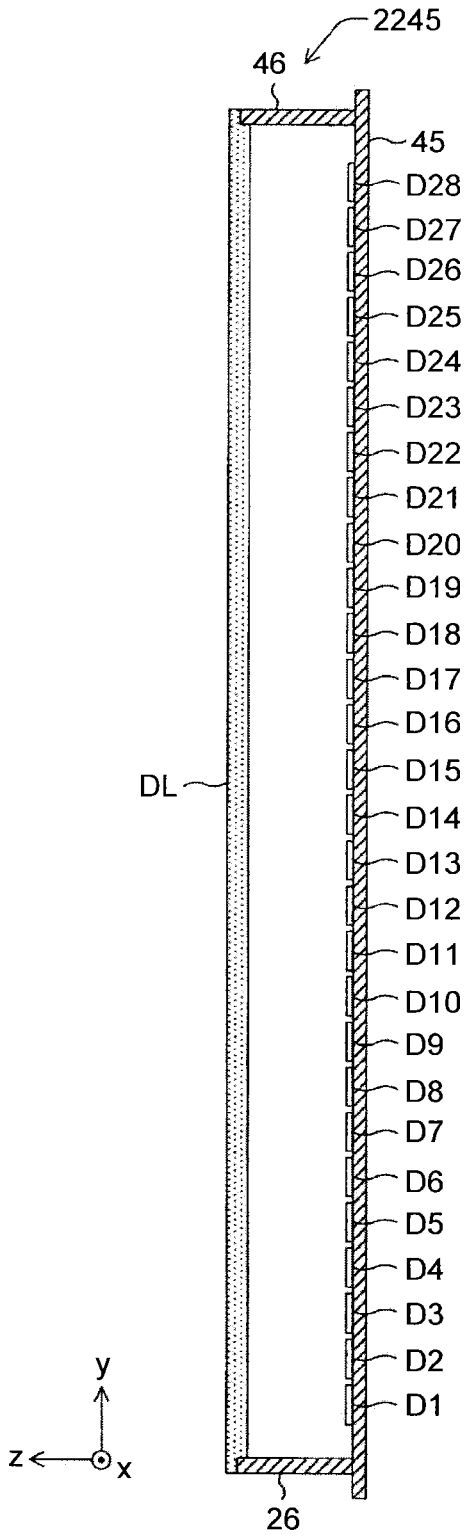
FIG. 7 is a (third) diagram for explaining the reflective optical sensor.
Figure 8:
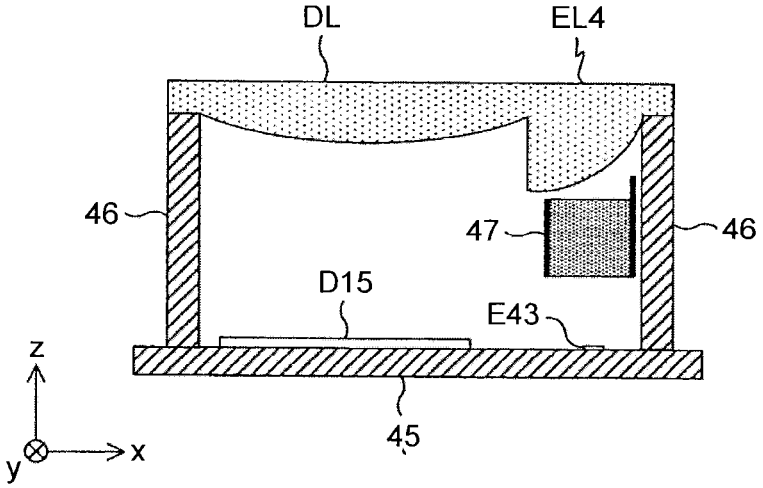
FIG. 8 is a (fourth) diagram for explaining the reflective optical sensor.
Figure 9:
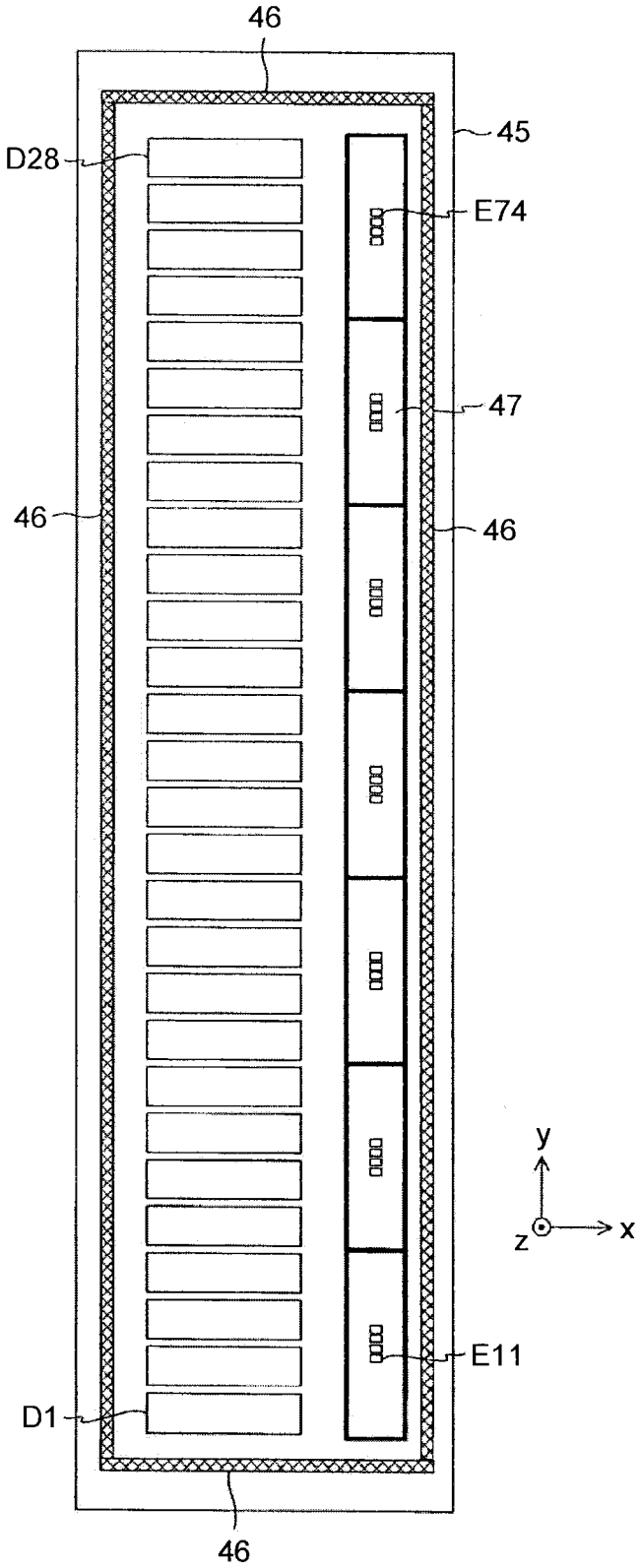
FIG. 9 is a (fifth) diagram for explaining the reflective optical sensor.
Figure 10:
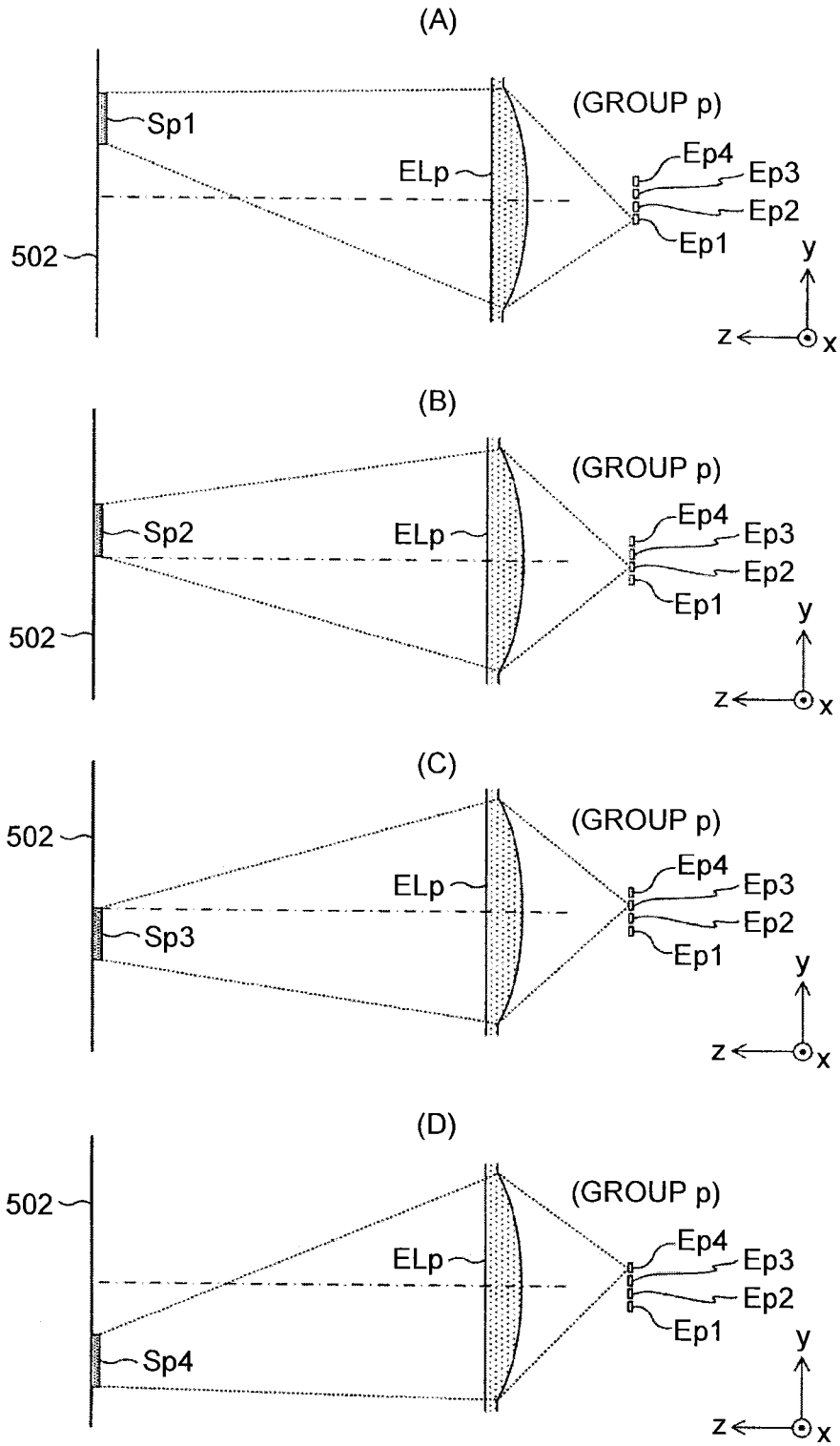
FIGS. 10(A) to 10(D) are diagrams for explaining a light spot formed on the surface of the fixing belt.
Figure 11:
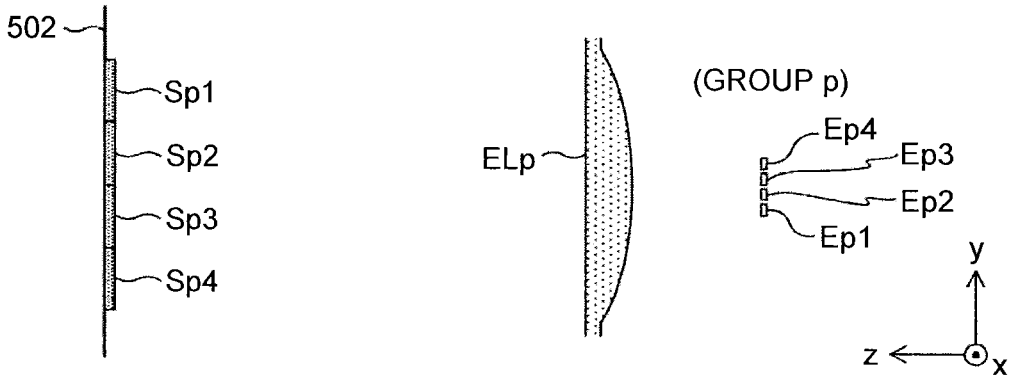
FIG. 11 is a diagram for explaining the order of light-emitting parts in Group p in a y-axis direction and the order of the formation positions of light spots in the y-axis direction.
Figure 12:
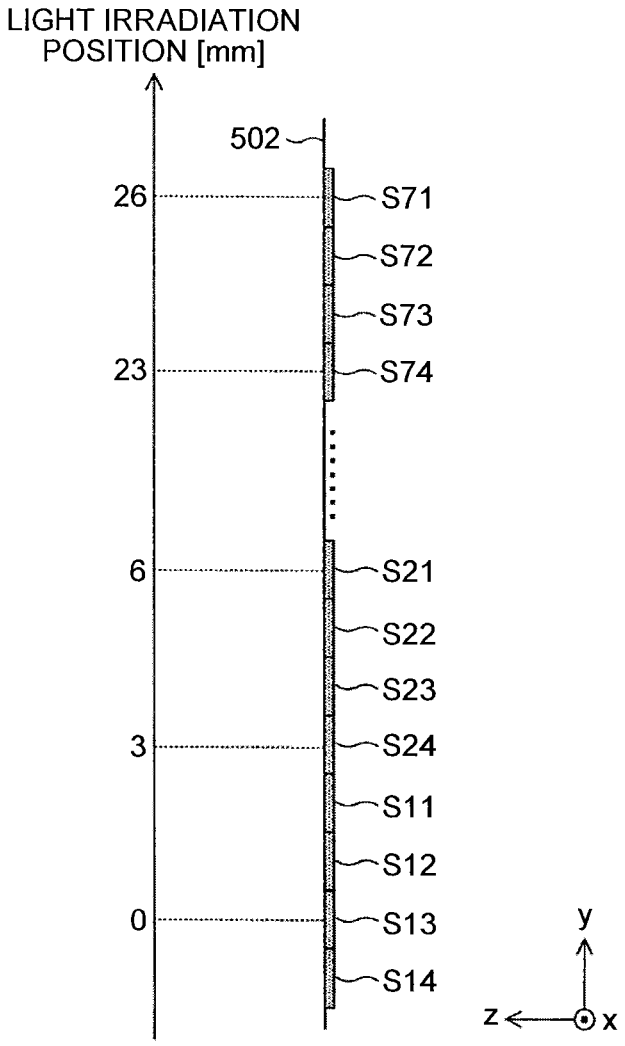
FIG. 12 is a diagram for explaining a light irradiation position.

A configuration of the reflective optical sensor 2245 is explained with FIGS. 5 to 9. FIG. 6 is a cross-sectional view of the reflective optical sensor 2245 along a line A-A shown in FIG. 5. FIG. 7 is a cross-sectional view of the reflective optical sensor 2245 along a line B-B shown in FIG. 5. FIG. 8 is a cross-sectional view of the reflective optical sensor 2245 along a line C-C shown in FIG. 5. FIG. 9 is a diagram showing the reflective optical sensor 2245 with a lens member shown in FIG. 5 off.

The reflective optical sensor 2245 has a quadrangular prism-like contour whose long side is parallel to the y-axis direction, and includes twenty-eight light-emitting parts, seven illumination lenses (EL1 to EL7), one light-receiving lens DL, twenty-eight light-receiving parts (D1 to D28), a substrate 45, a frame member 46, and an apertured member 47, etc. The seven illumination lenses and the one light-receiving lens DL are all made of resin, and an integrated combination of these is the lens member.

The twenty-eight light-emitting parts are divided into seven groups (Groups 1 to 7) composed of four light-emitting parts. Four light-emitting parts in each group are arranged adjacently in the y-axis direction. Four light-emitting parts in Group p (p=1 to 7) are referred to as a "light-emitting part Ep1", a "light-emitting part Ep2", a "light-emitting part Ep3", and a "light-emitting part Ep4" in order toward the +y direction. Furthermore, intervals between the groups in the y-axis direction are equal. The light-emitting parts are individually turned on and off by the printer control device 2090. Incidentally, hereinafter, a light-emitting part turned on is also referred to as a "lighting-up light-emitting part" for convenience sake.

The seven illumination lenses correspond to the seven groups, respectively. Each illumination lens collectively leads lights emitted from light-emitting parts in a corresponding group toward the surface of the fixing belt 502. A illumination lens corresponding to Group p is hereinafter referred to as an "illumination lens ELp".

In Group p, a light emitted from the light-emitting part Ep1 is collected by the illumination lens ELp, and a light spot Sp1 is formed on the surface of the fixing belt 502 (see FIG. 10(A)). A light emitted from the light-emitting part Ep2 is collected by the illumination lens ELp, and a light spot Sp2 is formed on the surface of the fixing belt 502 (see FIG. 10(B)). A light emitted from the light-emitting part Ep3 is collected by the illumination lens ELp, and a light spot Sp3 is formed on the surface of the fixing belt 502 (see FIG. 10(C)). A light emitted from the light-emitting part Ep4 is collected by the illumination lens ELp, and a light spot Sp4 is formed on the surface of the fixing belt 502 (see FIG. 10(D)).

The light spots are formed in different positions on the surface of the fixing belt 502 to be aligned in the y-axis direction. The direction of alignment of the four light-emitting parts and the direction of alignment of the four light spots are the opposite in the y-axis direction (see FIG. 11). Here, the formation pitch (center-to-center spacing) of multiple light spots in the y-axis direction is 1 mm. Incidentally, the position on the surface of the fixing belt 502 where a light spot is formed is also referred to as a "light irradiation position" (see FIG. 12). Here, as an example, the position where a light spot S13 is formed is set as the original point (0 mm) of the light irradiation position.

Figure 13:
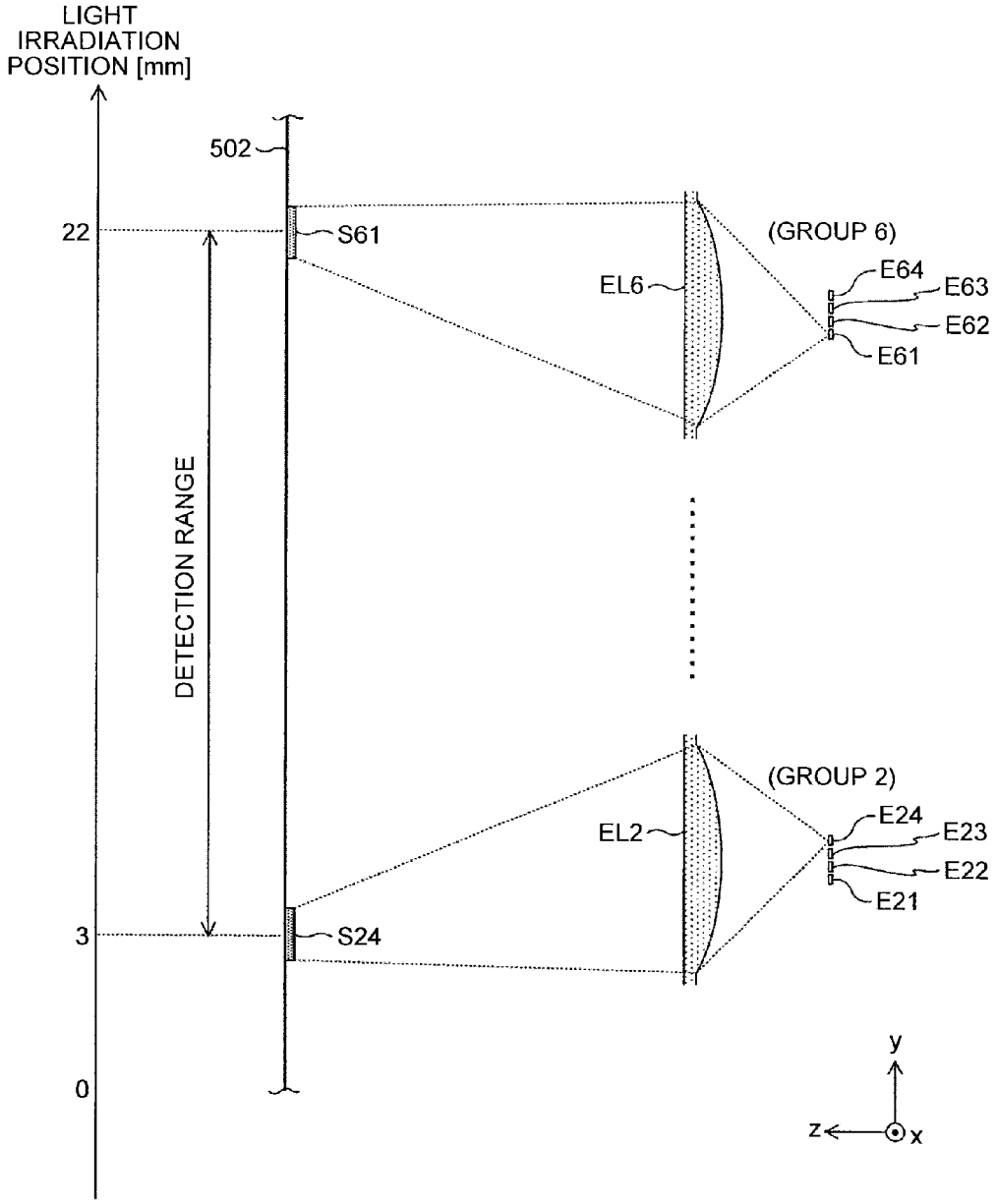
FIG. 13 is a diagram for explaining a detection range of the reflective optical sensor.

In the present embodiment, positions of abrasions on the fixing belt 502 and conditions of the abrasions (depths of the abrasions, widths of the abrasions) are detected by using twenty light-emitting parts in Groups 2 to 6. As shown in FIG. 13 for instance, the area between the formation position of a light spot S24 formed of a light emitted from the light-emitting part E24 in Group 2 and the formation position of a light spot S61 formed of a light emitted from the light-emitting part E61 in Group 6 is a range of detection in the y-axis direction (hereinafter, also referred to simply as a "detection range"). Here, 19 mm is the detection range.

Incidentally, when an A4-size recording sheet in portrait orientation is fed through the fixing belt 502, the position of the recording sheet in the y-axis direction varies slightly. Furthermore, if a so-called "belt skew" occurs in the fixing belt 502, the relative position of the recording sheet in the y-axis direction to the fixing belt 502 varies. Moreover, the position of a recording sheet in the y-axis direction may be intentionally adjusted to differ from one recording sheet to another. Therefore, the positions of both ends of the recording sheet in the y-axis direction also vary. A range of this variation (a variation width) is 10 mm or less. The abrasion sites exist within the variation range, and therefore it is necessary to set the detection range of the reflective optical sensor 2245 to be larger than the variation width.

In the present embodiment, the detection range of the reflective optical sensor 2245 is 19 mm and is larger than the variation width, and therefore it is possible to detect the abrasion sites certainly. Furthermore, the detection range of the reflective optical sensor 2245 is considerably larger than the variation width, and therefore the installation position of the reflective optical sensor 2245 in the y-axis direction can be rough to a certain extent.

The twenty-eight light-receiving parts are arranged at equal spaces along the y-axis direction (see FIG. 9). Here, the arrangement pitch of the twenty-eight light-receiving parts is 1 mm. Each of the light-receiving parts outputs a level of signal (photoelectric conversion signal) according to an amount of light received to the printer control device 2090.

The light-receiving lens DL is a single cylindrical lens placed on the +z side of the twenty-eight light-receiving parts, and has positive optical power in the x-axis direction only (see FIGS. 7 and 8).

Figure 14:
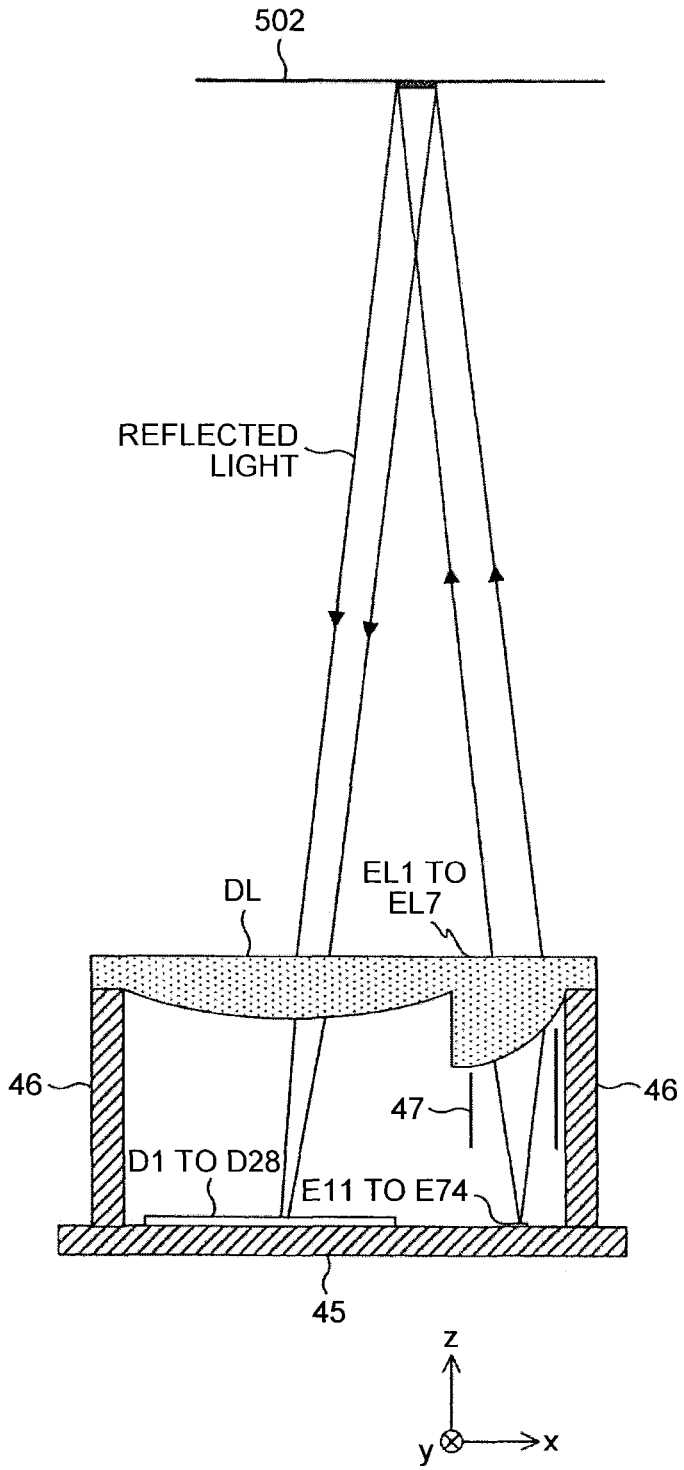
FIG. 14 is a (first) diagram for explaining a light path of a reflected light.
Figure 15:
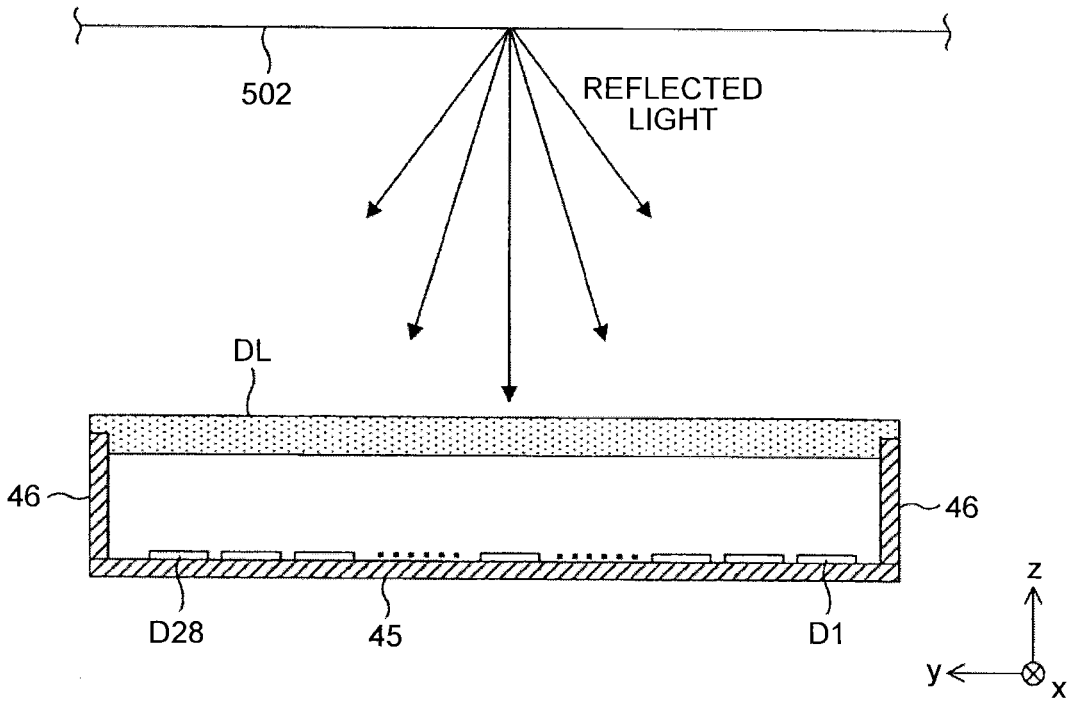
FIG. 15 is a (second) diagram for explaining a light path of a reflected light.
Figure 16:
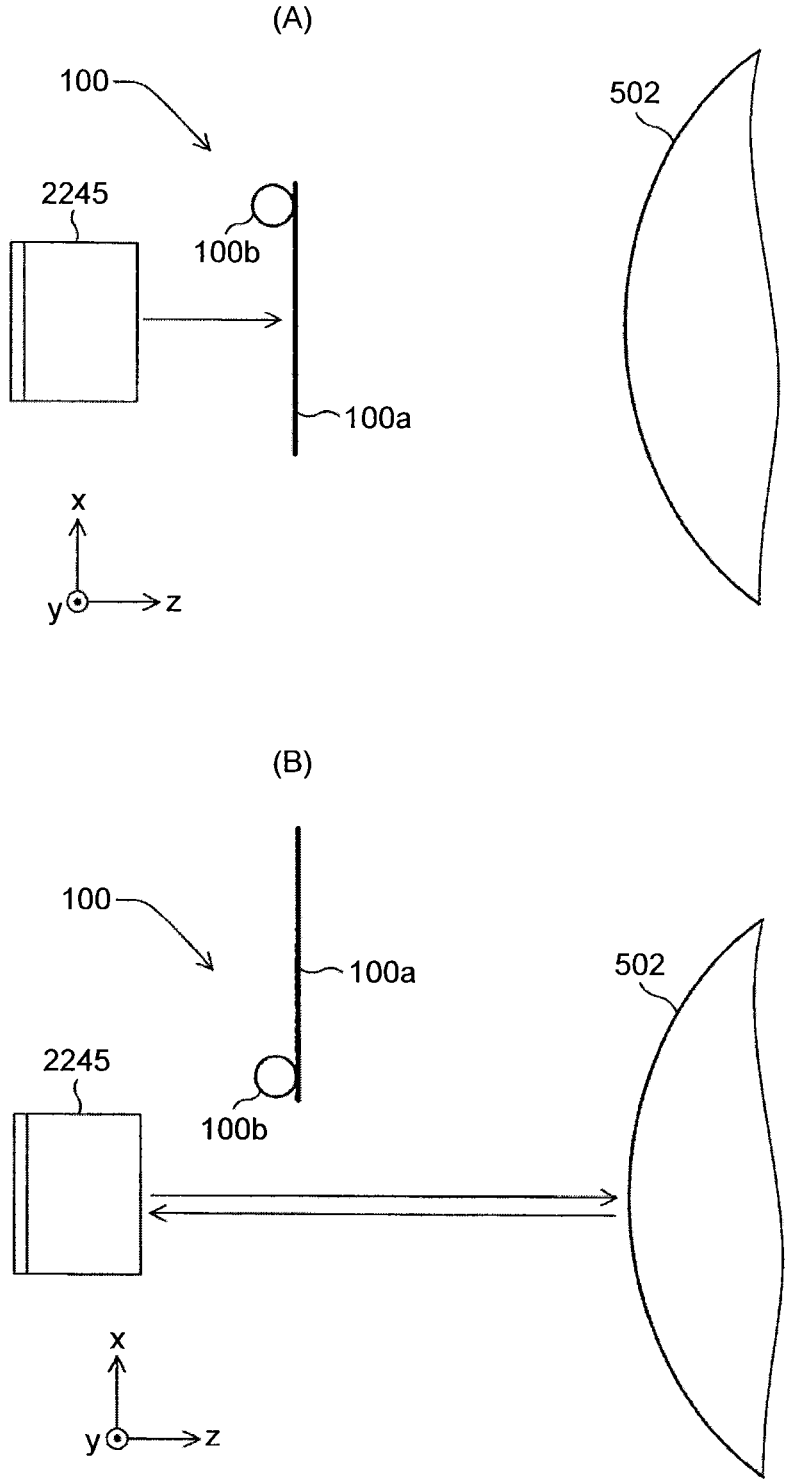
FIGS. 16(A) and 16(B) are diagrams for explaining a light blocking mechanism.

Out of light reflected by the fixing belt 502, only a light reflected in the x-axis direction is collected by the light-receiving lens DL, and enters the light-receiving parts (see FIGS. 14 and 15).

The frame member 46 is placed between the substrate 45 and the lens member so that an interval between the substrate 45 and the lens member is an intended interval. Accordingly, the twenty-eight light-emitting parts and the twenty-eight light-receiving parts are sealed in a space formed by the substrate 45, the lens member, and the frame member 46; therefore, it is possible to prevent the light-emitting parts and the light-receiving parts from contamination. Incidentally, the frame member 46 is made of resin, and can be integrally molded with the lens member.

The apertured member 47 is placed between the plurality of light-emitting parts and the plurality of illumination lenses, and prevents a light emitted from a light-emitting part from entering an illumination lens corresponding to an adjacent group, and also prevents light other than a reflected light from an object from entering the light-receiving parts. Incidentally, the apertured member 47 is made of resin, and can be integrally molded with at least any one of the lens member and the frame member 46. Here, the apertured member 47 has seven apertures (through holes) corresponding to the seven groups. The apertured member 47 can be made by boring holes in a blockish member, or can be made by combining multiple plate-like members.

The light blocking mechanism 100 is placed between the reflective optical sensor 2245 and the fixing belt 502. This light blocking mechanism 100 includes a light blocking member 100*a* and a drive unit 100*b*; for example, as shown in FIGS. 16(A) and 16(B), the light blocking member 100*a* can be moved in the x-axis direction by the drive unit 100*b*. Hereinafter, a state of the light blocking member 100*a* when the light blocking member 100*a* is in the position shown in FIG. 16(A) is referred to as a "closed state", and a state of the light blocking member 100*a* when the light blocking member 100*a* is in the position shown in FIG. 16B is referred to as an "open state". The drive unit 100*b* is controlled by the printer control device 2090.

The light blocking member 100*a* is made mainly of opaque engineering plastic having heat resistance to high temperature, and a black low-reflection member is attached to the −z side of the light blocking member 100*a*. Incidentally, super engineering plastic having particularly-high heat resistance can be used in the light blocking member 100*a*.

The black low-reflection member includes for example a thin light-absorbing film, and has a function of absorbing light emitted from the reflective optical sensor 2245 when the light blocking member 100*a* is in the "closed state" so that the light is not received by the light-receiving parts of the reflective optical sensor 2245. Incidentally, if the engineering plastic used in the light blocking member 100*a* has a low-reflection function, there is no need to install the black low-reflection member.

Furthermore, the light blocking member 100*a* is configured to have the length in the y-axis direction equal to or slightly longer than the width (the length in the y-axis direction) of the fixing belt 502, and also has a heat shielding function of preventing heat from the fixing belt 502 from being directly transmitted to the reflective optical sensor 2245.

When the light blocking member 100*a* is in the "open state", light emitted from the reflective optical sensor 2245 is delivered to the fixing belt 502, and the light reflected by the surface of the fixing belt 502 enters the reflective optical sensor 2245. On the other hand, when the light blocking member 100*a* is in the "closed state", light emitted from the reflective optical sensor 2245 is absorbed by the light blocking member 100*a*, and does not enter the reflective optical sensor 2245.

Figure 17:
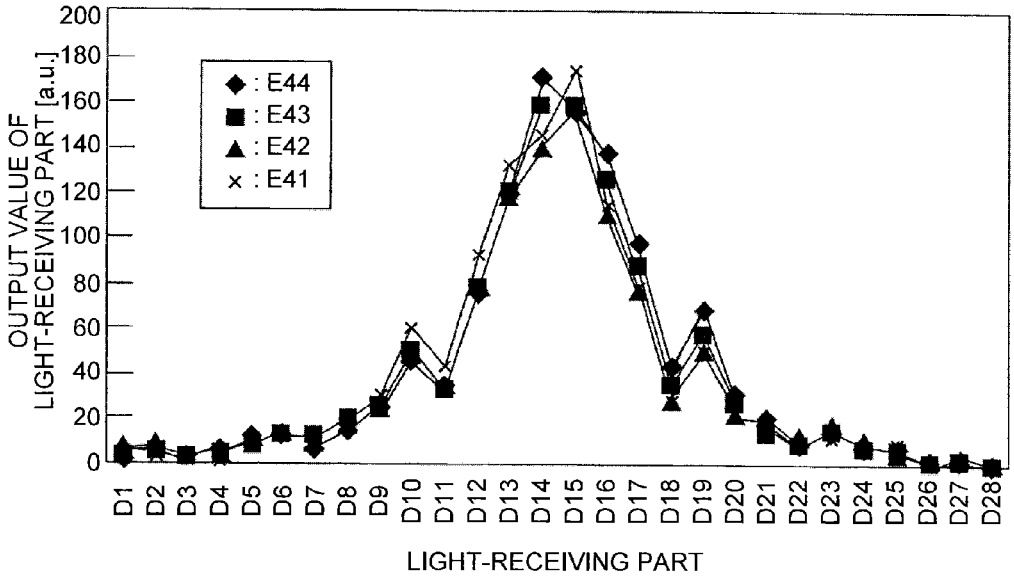
FIG. 17 is a diagram for explaining respective output values of light-receiving parts when light-emitting parts E41, E42, E43, and E44 are individually turned on in a state where a light blocking member is in a "closed state"
Figure 18:
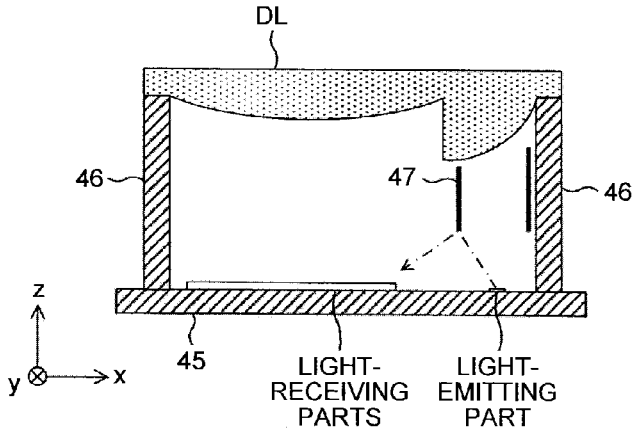
FIG. 18 is a diagram for explaining a reason why the output values of the light-receiving parts never become zero when the light blocking member is in the "closed state"

FIG. 17 shows relative output values of the light-receiving parts when the light-emitting parts E41, E42, E43, and E44 are individually turned on in a state where the light blocking member 100*a* is in the "closed state", i.e., there is no object that reflects light emitted from the reflective optical sensor 2245. If there is no object that reflects the light, respective output values of the light-receiving parts should normally be all zero; however, as shown in FIG. 17, an output distribution in which output values of the light-receiving parts D14 and D15 are the peak value was obtained. The inventors investigated the cause of the occurrence of this output distribution in detail, and found that a portion of light emitted from a light-emitting part is reflected by the front face (the face on the −z side) of the apertured member 47 and received by the light-receiving parts as shown in FIG. 18.

Figure 19:
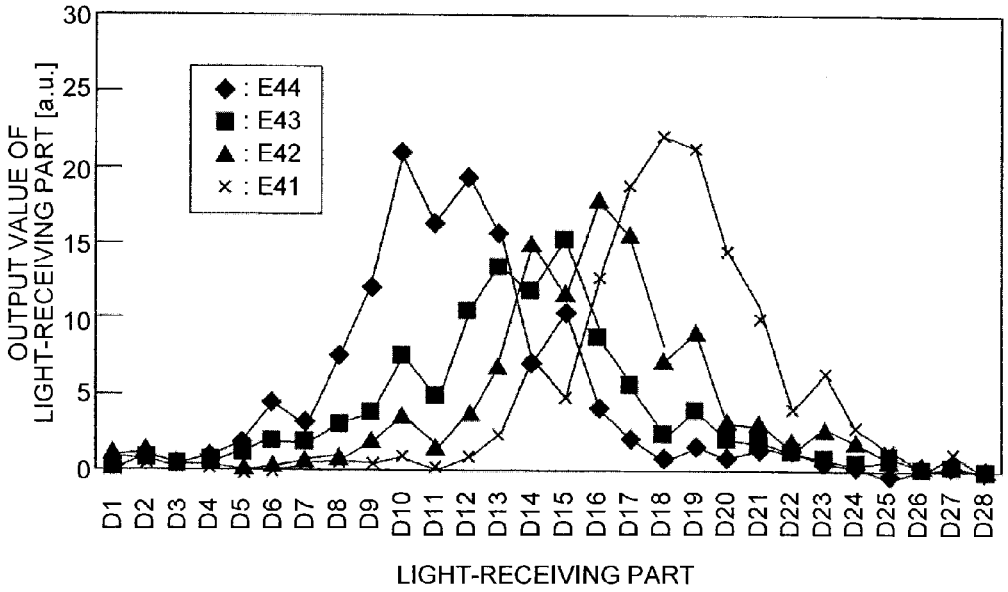
FIG. 19 is a diagram for explaining respective output values of the light-receiving parts when output of each light-receiving part when the light blocking member is in the "closed state" is subtracted from that of when the light blocking member is in an "open state"

FIG. 19 shows results of subtracting respective output values of the light-receiving parts when the light-emitting parts E41, E42, E43, and E44 are individually turned on in a state where the light blocking member 100*a* is in the "closed state", i.e., there is no object that reflects light emitted from the reflective optical sensor 2245 from respective output values of the light-receiving parts when the light-emitting parts E41, E42, E43, and E44 are individually turned on in a state where the light blocking member 100*a* is in the "open state", i.e., light emitted from the reflective optical sensor 2245 is reflected by the fixing belt 502 and the reflected light enters the reflective optical sensor 2245. This enables to obtain respective output values of the light-receiving parts when the light-receiving parts have received only a light reflected by the fixing belt 502.

To focus on the peak in the output values shown in FIG. 19, when a lighting-up light-emitting part changes like E44→E43→E42→E41, a light-receiving part of which the output value is the peak value shifts from a light-receiving part of low reference number to a light-receiving part of high reference number like D10→D15→D16→D18. This corresponds with a change in the formation position of a light spot on the surface of the fixing belt 502 in a +y direction with changing the lighting-up light-emitting part in a −y direction.

Incidentally, when the light blocking member 100*a* is in the "closed state", if one light-emitting part is turned on, a light emitted from the light-emitting part is directly reflected by the apertured member 47 and received by the light-receiving parts; therefore, if the shape of the apertured member 47 viewed from each light-emitting part is the same, it is considered that a signal proportional to an amount of light emitted from a light-emitting part is output from the reflective optical sensor 2245. Here, the size of an aperture of the apertured member 47 corresponding to one group is sufficiently larger than the size of a placement area of four light-emitting parts in the group; therefore, it can be considered that the shape of the apertured member 47 viewed from any light-emitting part is the same. Consequently, when output of the reflective optical sensor 2245 with respect to each light-emitting part is found by putting the light blocking member 100*a* into the "closed state" and individually turning on multiple light-emitting parts, it can be considered that a relationship between light-emitting parts and outputs of the reflective optical sensor 2245 corresponds with variation in an emitting light amount among multiple light-emitting parts at the time.

Figure 20:
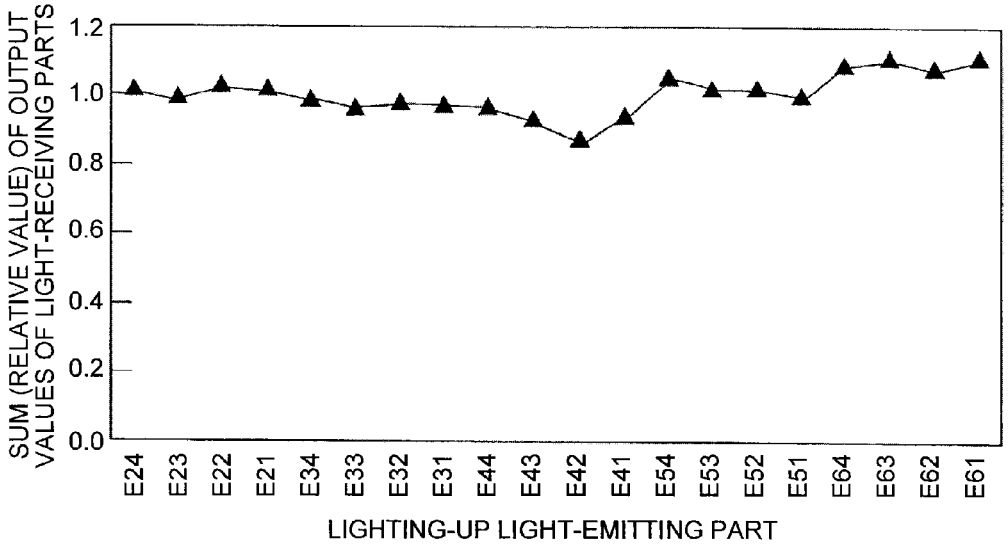
FIG. 20 is a diagram for explaining the sum of the output values of the light-receiving parts when the light-emitting parts are individually turned on in the state where the light blocking member is in the "closed state"

FIG. 20 shows the sum (a relative value) of outputs of the twenty-eight light-receiving parts when twenty light-emitting parts in Groups 2 to 6 are individually turned on in a state where the light blocking member 100*a* is in the "closed state". Incidentally, light-receiving parts of which the outputs are to be summed can be all of the twenty-eight light-receiving parts, or less than twenty-eight light-receiving parts consisting of a light-receiving part of which the output is the peak value and multiple light-receiving parts close to the light-receiving part can be selected. This depends on an optical system of the reflective optical sensor 2245, and therefore it is only necessary to set light-receiving parts of which the outputs are to be summed in advance through experiments or the like.

Figure 21:
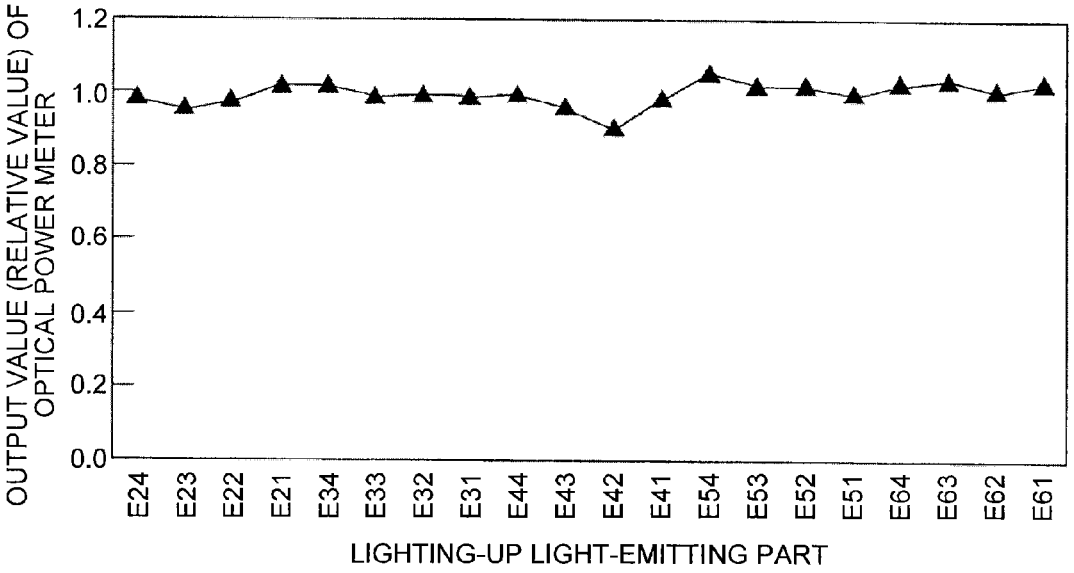
FIG. 21 is a diagram for explaining output values of an optical power meter when the light-emitting parts are individually turned on in the state where the light blocking member is in the "open state"

FIG. 21 shows results (relative values) of light amounts measured by an optical power meter when the twenty light-emitting parts in Groups 2 to 6 are individually turned on in a state where the light blocking member 100*a* is in the "open state".

By comparison of FIGS. 20 and 21, we can find that FIGS. 20 and 21 show the same trend. Namely, variation in an emitting light amount among the multiple light-emitting parts can be known by using the sum of outputs of light-receiving parts when the light blocking member 100*a* is in the "closed state" instead of directly measuring an emitting light amount of each light-emitting part.

The printer control device 2090 uses the reflective optical sensor 2245 to check a surface condition of the fixing belt 502 when an image is printed on an A4 recording sheet in landscape orientation or an A3 recording sheet after images have been printed on a predetermined number of (for example, 500) A4 recording sheets in portrait orientation. This surface-condition checking process is explained with FIGS. 22 to 24. Flowcharts shown in FIGS. 22 to 24 correspond to a sequence of processing algorithms executed by the CPU of the printer control device 2090 in the surface-condition checking process.

At the first Step S401, the light blocking member 100*a* is put into the "closed state" through the drive unit 100*b*. Incidentally, if the light blocking member 100*a* is already in the "closed state", the process at Step S401 is skipped.

At the next Step S403, a variable m indicating repeat counts is set to an initial value of 1.

At the next Step S405, a variable p indicating group is set to an initial value of 2.

At the next Step S407, a variable q indicating a light-emitting part in Group p is set to an initial value of 4.

At the next Step S409, a light-emitting part Epq is turned on. Namely, the light-emitting part Epq is a lighting-up light-emitting part.

At the next Step S411, output signals of light-receiving parts corresponding to the light-emitting part Epq are acquired. In the present embodiment, as an example, a total of five light-receiving parts: a light-receiving part of which the output is the peak value when one light-emitting part has emitted a light, two light-receiving parts located on the +y side of the light-receiving part, and two light-receiving parts located on the −y side of the light-receiving part are light-receiving parts corresponding to the one light-emitting part.

At the next Step S413, the light-emitting part Epq is turned off.

At the next Step S415, the output signals of the light-receiving parts corresponding to the light-emitting part Epq are stored in the RAM of the printer control device 2090 in a manner associated with the light-emitting part Epq.

At the next Step S417, whether or not a value of q exceeds 1 is determined. When a value of q exceeds 1, the answer to the determination here is YES, and the process moves onto Step S419.

At Step S419, the value of q is decremented by one, and the process returns to the above-described Step S409.

The processes at Steps S409 to S419 are repeatedly performed until the answer to the determination at Step S417 has become NO.

When the value of q has become 1, the answer to the determination at Step S417 becomes NO, and the process moves onto Step S421.

At Step S421, whether a value of p is less than 6 is determined. When a value of p is less than 6, the answer to the determination here is YES, and the process moves onto Step S423.

At Step S423, the value of p is incremented by one, and the process returns to the above-described Step S407.

The processes at Steps S407 to S423 are repeatedly performed until the answer to the determination at Step S421 has become NO.

When the value of p has become 6, the answer to the determination at Step S421 becomes NO, and the process moves onto Step S425.

At Step S425, whether a value of m is less than a preset integer M (M≥2) is determined. When a value of m is less than M, the answer to the determination here is YES, and the process moves onto Step S427.

At Step S427, the value of m is incremented by one, and the process returns to the above-described Step S405.

The processes at Steps S405 to S427 are repeatedly performed until the answer to the determination at Step S425 has become NO.

Figure 23:
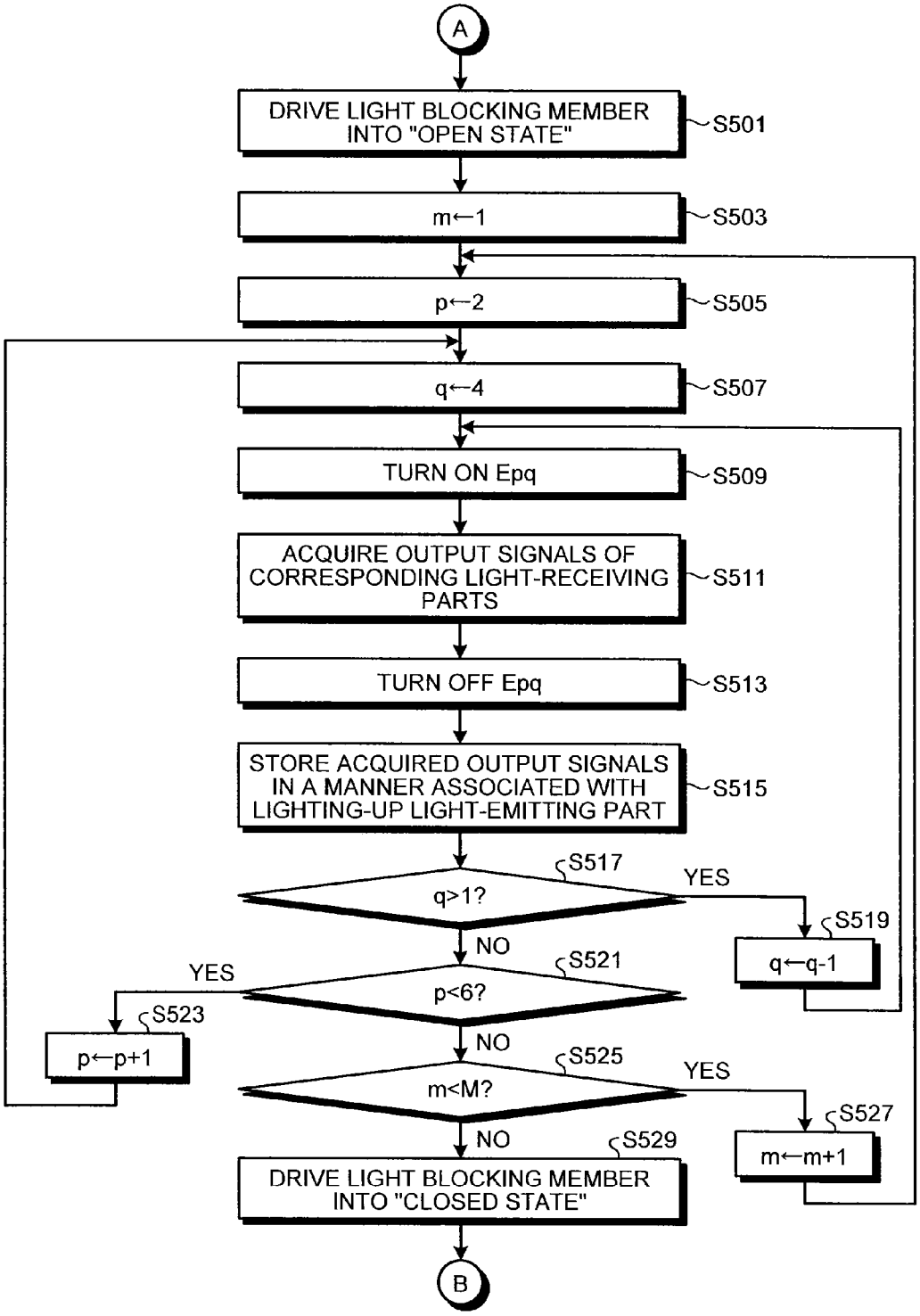
FIG. 23 is a (second) flowchart for explaining the surface-condition checking process.

When the value of m has become M, the answer to the determination at Step S425 becomes NO, and the process moves onto Step S501 (FIG. 23).

At Step S501, the light blocking member 100*a* is put into the "open state" through the drive unit 100*b*.

At the next Step S503, the variable m indicating repeat counts is set to the initial value of 1.

At the next Step S505, the variable p indicating group is set to the initial value of 2.

At the next Step S507, the variable q indicating a light-emitting part in Group p is set to the initial value of 4.

At the next Step S509, a light-emitting part Epq is turned on. Namely, the light-emitting part Epq is a lighting-up light-emitting part.

At the next Step S511, output signals of light-receiving parts corresponding to the light-emitting part Epq are acquired.

At the next Step S513, the light-emitting part Epq is turned off.

At the next Step S515, the output signals of the light-receiving parts corresponding to the light-emitting part Epq are stored in the RAM of the printer control device 2090 in a manner associated with the light-emitting part Epq.

At the next Step S517, whether or not a value of q exceeds 1 is determined. When a value of q exceeds 1, the answer to the determination here is YES, and the process moves onto Step S519.

At Step S519, the value of q is decremented by one, and the process returns to the above-described Step S509.

The processes at Steps S509 to S519 are repeatedly performed until the answer to the determination at Step S517 has become NO.

When the value of q has become 1, the answer to the determination at Step S517 becomes NO, and the process moves onto Step S521.

At Step S521, whether or not a value of p is less than 6 is determined. When a value of p is less than 6, the answer to the determination here is YES, and the process moves onto Step S523.

At Step S523, the value of p is incremented by one, and the process returns to the above-described Step S507.

The processes at Steps S507 to S523 are repeatedly performed until the answer to the determination at Step S521 has become NO.

When the value of p has become 6, the answer to the determination at Step S521 becomes NO, and the process moves onto Step S525.

At Step S525, whether or not a value of m is less than the preset integer M (M≥2) is determined. When a value of m is less than M, the answer to the determination here is YES, and the process moves onto Step S527.

At Step S527, the value of m is incremented by one, and the process returns to the above-described Step S505.

The processes at Steps S505 to S527 are repeatedly performed until the answer to the determination at Step S525 has become NO.

When the value of m has become M, the answer to the determination at Step S525 becomes NO, and the process moves onto Step S529.

At Step S529, the light blocking member 100*a* is put into the "closed state" through the drive unit 100*b*. The light blocking member 100*a* is put into the "closed state" in this way except when necessary, thereby it is possible to suppress an increase in temperature of the reflective optical sensor 2245 due to heat from the fixing device 2050.

At the next Step S601 (FIG. 24), respective output signals of light-receiving parts corresponding to a lighting-up light-emitting part at each lighting-up timing, which have been acquired when the light blocking member 100*a* was in the "open state", are read out from the RAM, and any of an average value of M output values of each of light-receiving parts with respect to each light-emitting part, a median value of the M output values, an average value of the M output values except abnormal value(s), and a median value of the M output values except the abnormal value(s) is found as a first detection value. Incidentally, if M is 5 or greater, any of an average value of three or more output values excluding the maximum and minimum values, a median value of the three or more output values, an average value of the three or more output values except abnormal value(s), and a median value of the three or more output values except the abnormal value(s) can be found as a first detection value.

At the next Step S603, respective output signals of light-receiving parts corresponding to a lighting-up light-emitting part at each lighting-up timing, which have been acquired when the light blocking member 100*a* was in the "closed state", are read out from the RAM, and any of an average value of M output values of each of light-receiving parts with respect to each light-emitting part, a median value of the M output values, an average value of the M output values except abnormal value(s), and a median value of the M output values except the abnormal value(s) is found as a second detection value. Incidentally, if M is 5 or greater, any of an average value of three or more output values excluding the maximum and minimum values, a median value of the three or more output values, an average value of the three or more output values except abnormal value(s), and a median value of the three or more output values except the abnormal value(s) can be found as a second detection value.

At the next Step S605, with respect to each light-emitting part, a second detection value for each light-receiving part is subtracted from a first detection value for the light-receiving part, and the calculated value is set as a third detection value. Accordingly, an output value of each light-receiving part when the light-receiving part has received only a light reflected by the fixing belt 502 can be obtained.

At the next Step S607, with respect to each light-emitting part, respective third detection values for light-receiving parts are summed up, and the sum of the third detection values is set as a fourth detection value.

At the next Step S609, with respect to each light-emitting part, respective second detection values for light-receiving parts are summed up, and the sum of the second detection values is set as a fifth detection value.

At the next Step S611, with respect to each light-emitting part, a fourth detection value is divided by a fifth detection value, and the calculated value is set as a sixth detection value. Accordingly, the same output of light-receiving parts as that of the light-receiving parts when an equal amount of light is emitted from each light-emitting part can be obtained. Namely, variation in light-emitting characteristic among the light-emitting parts and a time-dependent change in light-emitting characteristic of each light-emitting part, etc. are corrected. An example of the sixth detection value is shown in FIG. 25.

Figure 25:
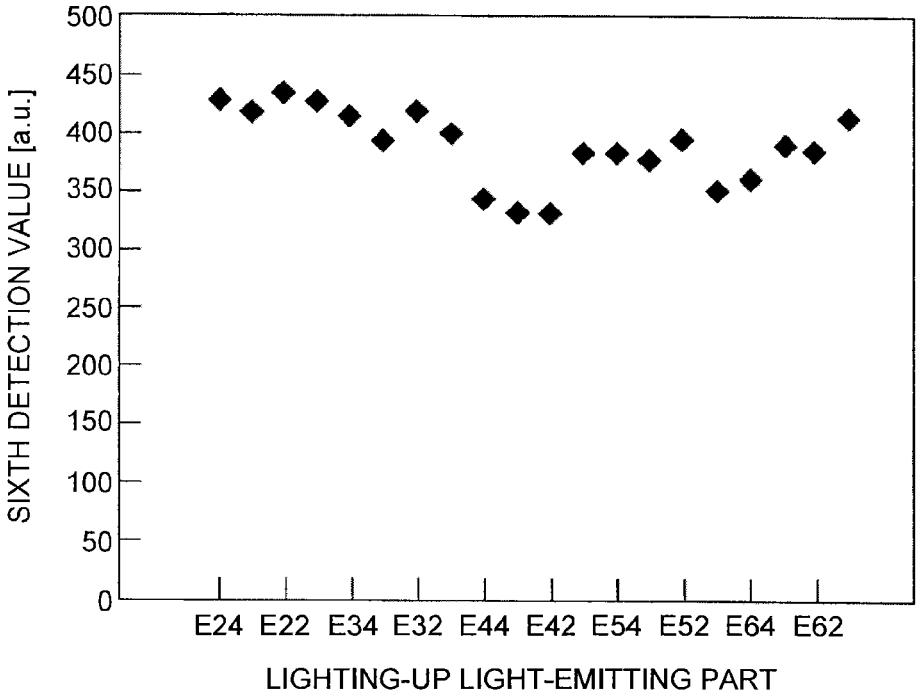
FIG. 25 is a diagram for explaining a relationship between a sixth detection value and a lighting-up light-emitting part.
Figure 26:
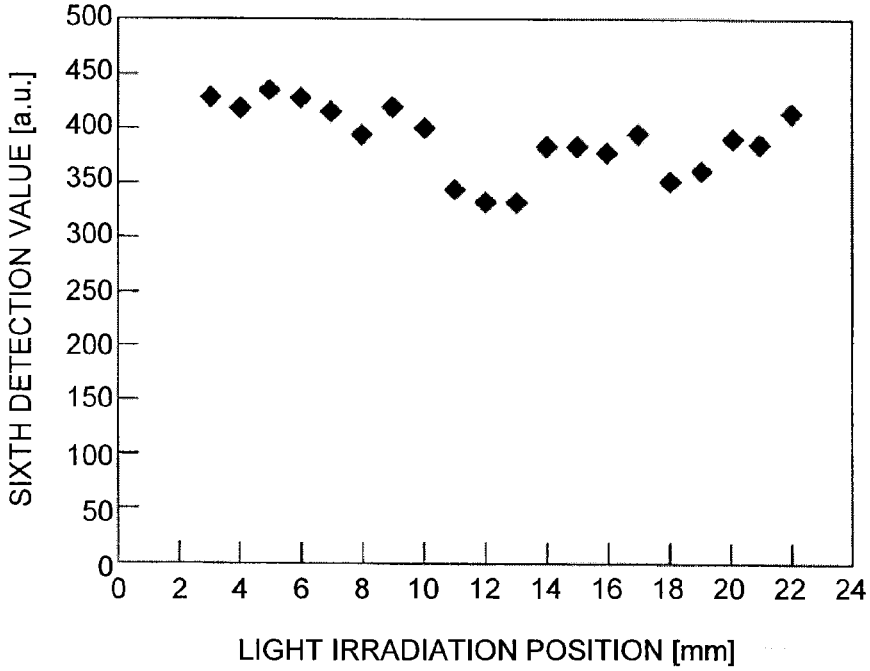
FIG. 26 is a diagram for explaining a relationship between the sixth detection value and a light irradiation position.
Figure 27:
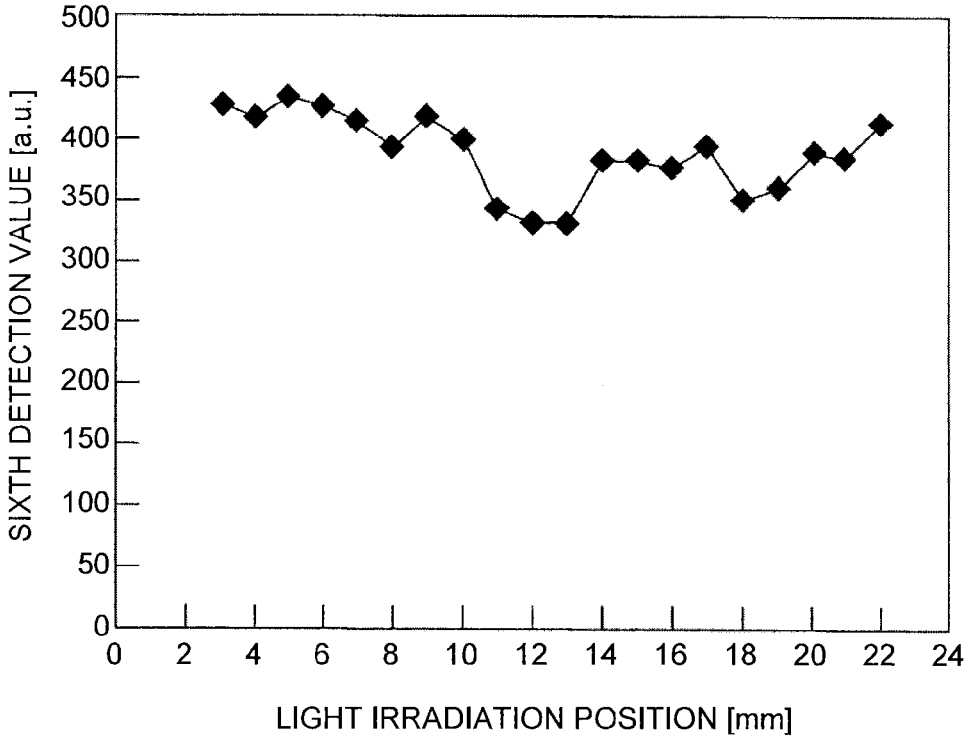
FIG. 27 is a diagram for explaining how to find a derivative value.
Figure 28:
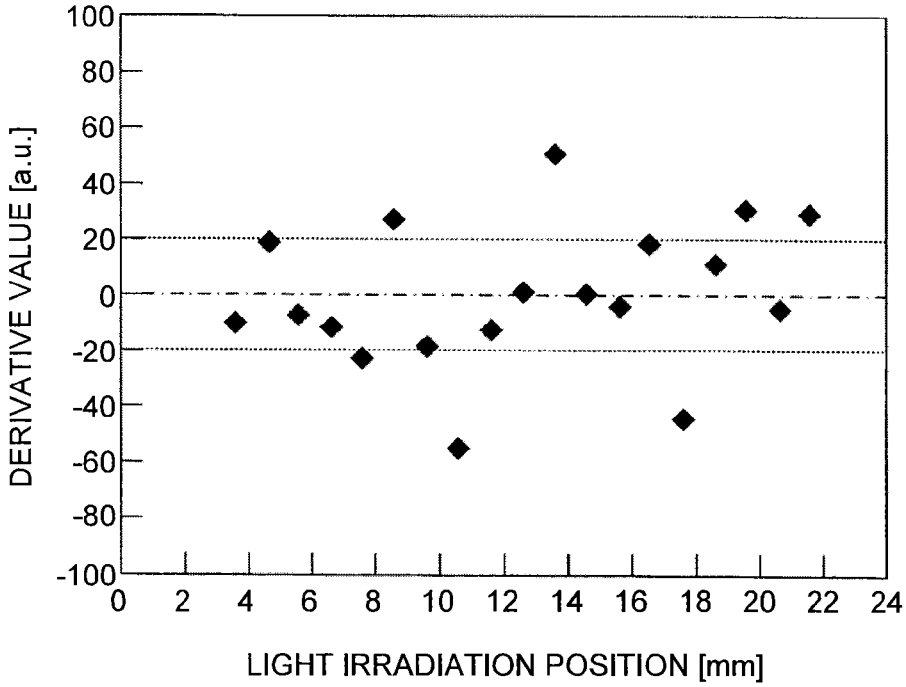
FIG. 28 is a diagram for explaining a relationship between a derivative value and light irradiation positions.

At the next Step S613, a lighting-up light-emitting part shown in FIG. 25 is converted into a light irradiation position, and a relationship between the light irradiation position and the sixth detection value is found (see FIG. 26).

At the next Step S615, sixth detection values in two light irradiation positions adjacent to each other in the y-axis direction are connected with a straight line (see FIG. 27), and the slope of the straight line is set as a derivative value in the middle point between the two light irradiation positions. Then, a relationship between the light irradiation positions and the derivative value is found (see FIG. 28). Incidentally, a way of finding a derivative value is not limited to this. For example, values at both ends of three successive light irradiation positions can be connected with a straight line, and the slope of the straight line can be set as a derivative value in the middle light irradiation position out of the three light irradiation positions.

At the next Step S617, whether or not there are any abrasions is determined. Here, when there is an absolute value of a derivative value exceeds 20 (a.u.), it is determined that there is an abrasion, and the process moves onto the next Step S619.

Figure 29:
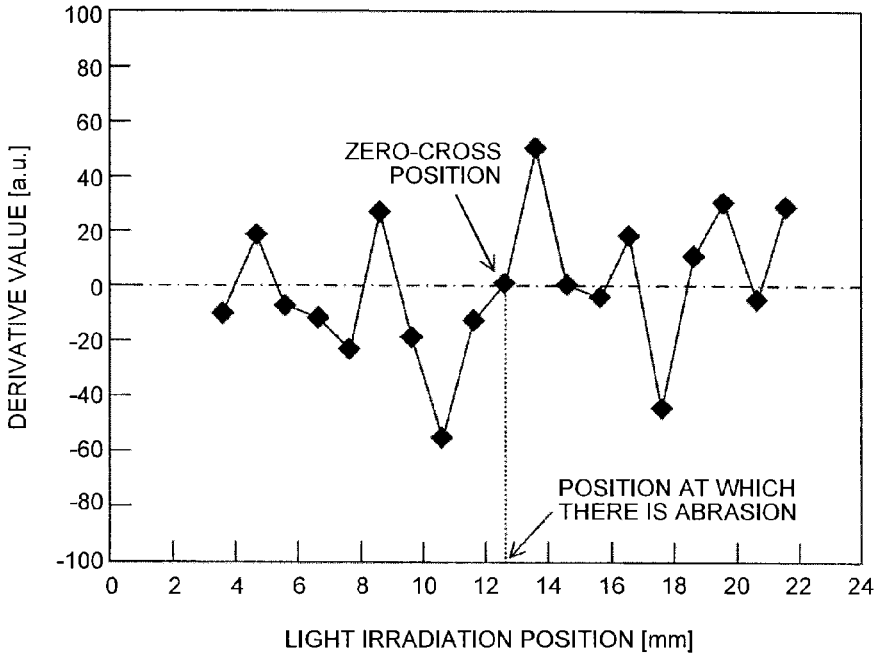
FIG. 29 is a diagram for explaining a zero-cross position.

At Step S619, the position of the abrasion is found. Here, the position at which a derivative value is 0 (a.u.) which varies from a value smaller than −20 (a.u.) to a value larger than +20 (a.u.) according to the position, which is a so-called zero-cross position is found (see FIG. 29). A light irradiation position corresponding to this zero-cross position is the position of the abrasion. In FIG. 29, it is determined that the abrasion is located in the position of 12.5 mm.

At the next Step S621, a parameter on the depth of the abrasion (hereinafter, referred to as a "depth parameter") is found. It is considered that the deeper the abrasion is, the more significantly the intensity of a reflected light received by a light-receiving part decreases. Namely, an amount of decrease in reflected light intensity corresponds with the depth of an abrasion.

Accordingly, a depth parameter can be found from a detection value in the position of the abrasion; however, due to an installation error of the reflective optical sensor 2245 and the tilt of the fixing belt 502, etc., a slope component may be superimposed on a relationship between light irradiation positions and detection values.

Figure 30:
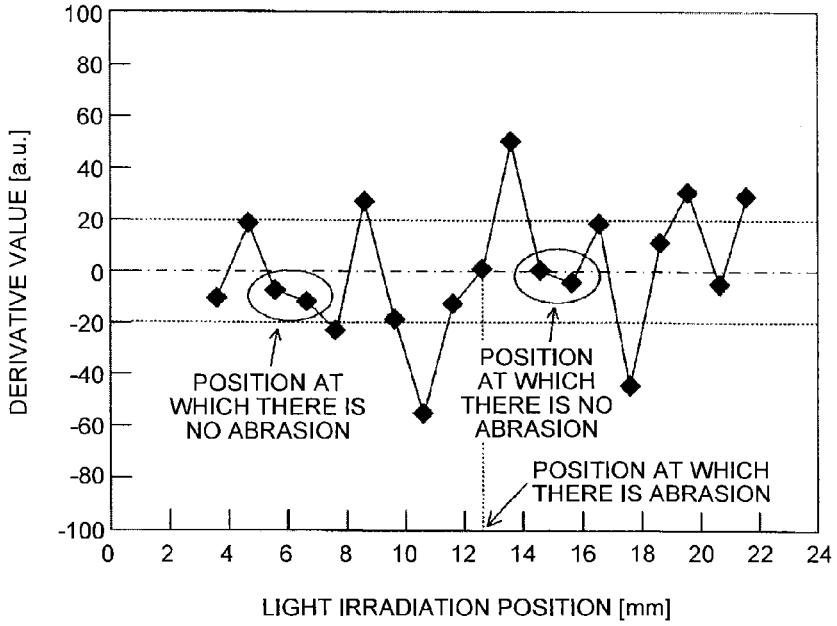
FIG. 30 is a (first) diagram for explaining a way of finding a depth parameter of an abrasion.

In this case, first, light irradiation positions where there are definitely no abrasions on the −y and +y sides of the position of the abrasion are found with reference to the relationship between the light irradiation positions and the derivative value (see FIG. 30). In FIG. 30, derivative values in light irradiation positions of 6 mm and 15 mm are close to zero, and it is definite that there are no abrasions in the light irradiation positions.

Figure 31:
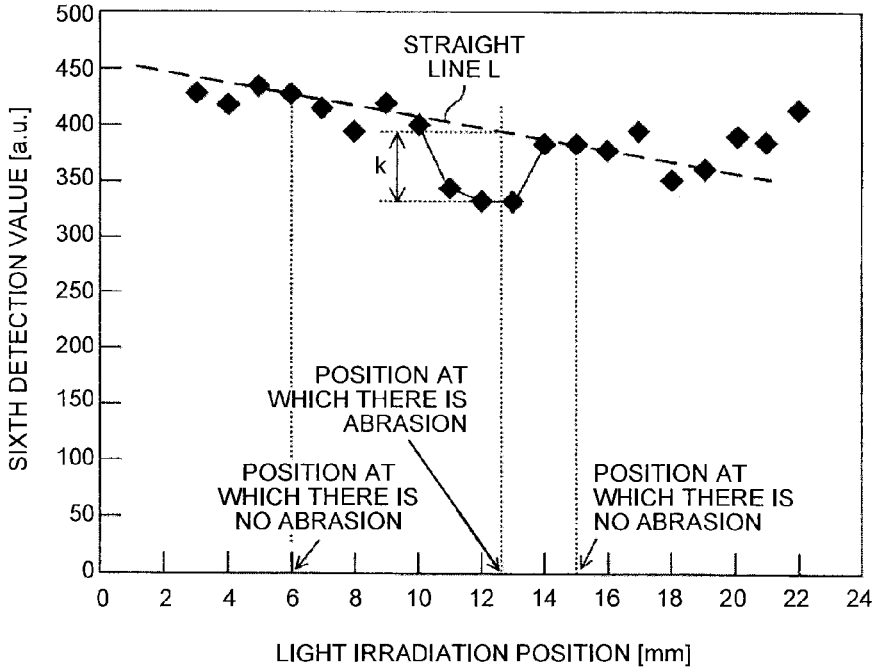
FIG. 31 is a (second) diagram for explaining the way of finding the depth parameter of the abrasion.

Next, in a relationship between light irradiation positions and sixth detection values, sixth detection values in the two light irradiation positions where there are definitely no abrasions are connected with a straight line L (see FIG. 31). The slope of this straight line L is the above-described slope component.

Next, an average value of the two sixth detection values in the light irradiation positions across the position of the abrasion or a smaller sixth detection value of the two sixth detection values is set as a detection value in the position of the abrasion.

Next, a difference k between a value of the straight line L in the position of the abrasion and the detection value in the position of the abrasion (see FIG. 31) is calculated. In FIG. 31, k is 63.1 (a.u.), and corresponds with a reflected-light-intensity decreasing rate of about 16%. The calculated k is a depth parameter; the larger a value of k, the deeper the abrasion. Here, a relationship between a value of k and image quality has been acquired in advance through experiments or the like, and has been stored in the ROM.

Figure 32:
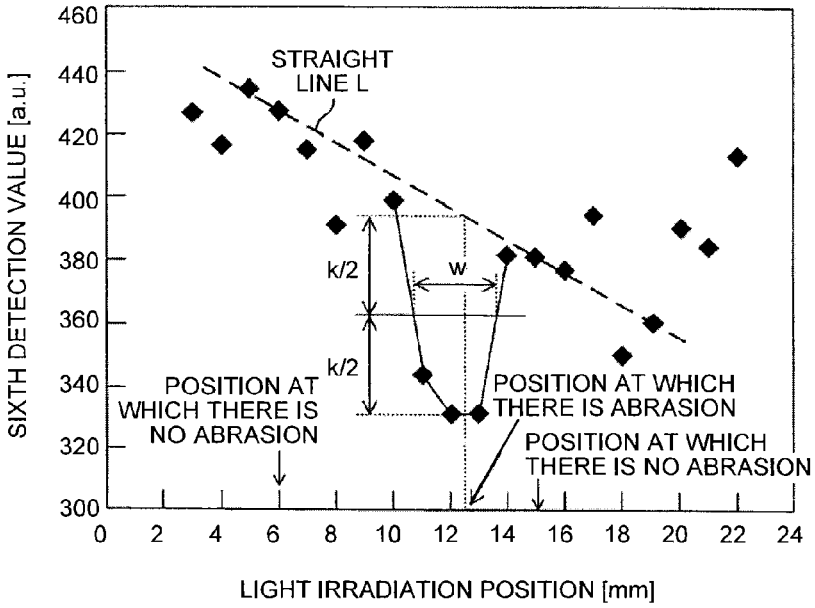
FIG. 32 is a diagram for explaining a way of finding the width of the abrasion.

At the next Step S623, the width of the abrasion is found. Here, the width of the abrasion in a light irradiation position corresponding to k/2 is set as width w of the abrasion (see FIG. 32). In FIG. 32, the width w of the abrasion is about 3 mm. Then, the surface-condition checking process is terminated.

Incidentally, at the above-described Step S617, if absolute values of all derivative values are equal to or lower than 20 (a.u.), it is determined that there are no abrasions, and the surface-condition checking process is terminated.

In the present embodiment, the influence of reflection by the apertured member 47 is eliminated from outputs of light-receiving parts when the light-receiving parts have received a light reflected by the fixing belt 502, and variation in an emitting light amount among light-emitting parts is corrected; therefore, it is possible to find the position of an abrasion on the fixing belt 502, a depth parameter of the abrasion, and the width of the abrasion with high accuracy.

Then, when at least either one of the depth parameter of the abrasion and the width of the abrasion exceeds their preset thresholds, the printer control device 2090 displays a message that there is an abrasion on the surface of the fixing belt 502, the position of the abrasion, the depth parameter of the abrasion, and the width of the abrasion on the display of the operation panel. An operator notifies a maintenance company of contents displayed on the display. Incidentally, the color printer 2000 can be configured to automatically notify this information to the maintenance company via a public line.

A maintenance man smoothes the surface of the fixing belt 502 depending on the position of the abrasion, the depth parameter of the abrasion, and the width of the abrasion. In this case, the position of the abrasion, the depth parameter of the abrasion, and the width of the abrasion have been acquired with high accuracy, and therefore, it is possible to prevent the maintenance man from smoothing the surface of the fixing belt 502 insufficiently or too much. Namely, maintenance of the fixing belt 502 can be performed appropriately. Therefore, reduction in image quality is suppressed, and the color printer 2000 can stably form excellent images.

As is obvious from the above explanation, in the present embodiment, a light-incidence adjusting mechanism according to the present invention is composed of the light blocking mechanism 100. Here, the "open state" is a first state, and the "closed state" is a second state. Furthermore, a processing unit according to the present invention is composed of the printer control device 2090. Then, in the above-described surface-condition checking process, a sensing method according to the present invention is implemented. Here, the first detection value is a first output value, and the second detection value is a second output value.

Figure 22:
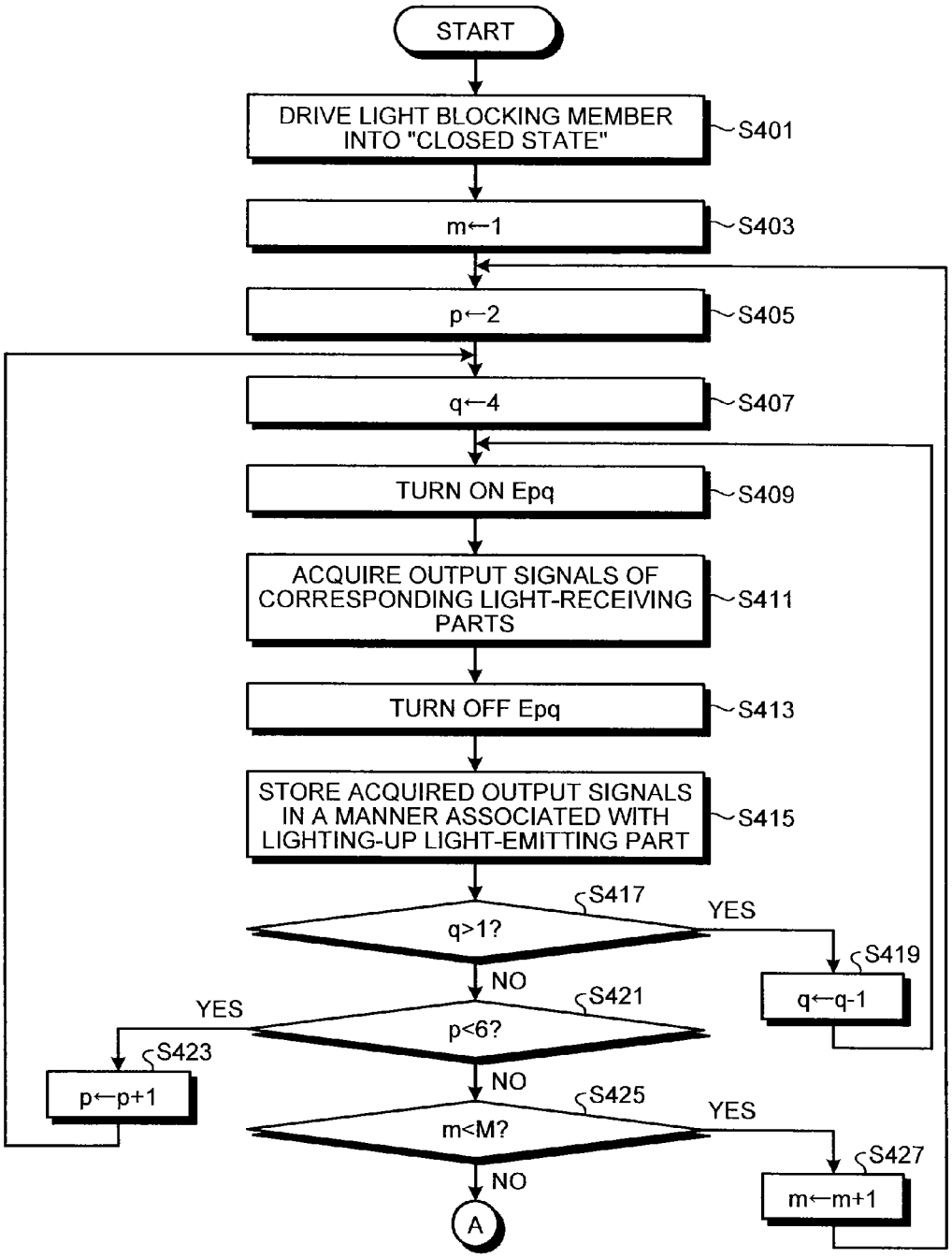
FIG. 22 is a (first) flowchart for explaining a surface-condition checking process.
Figure 24:
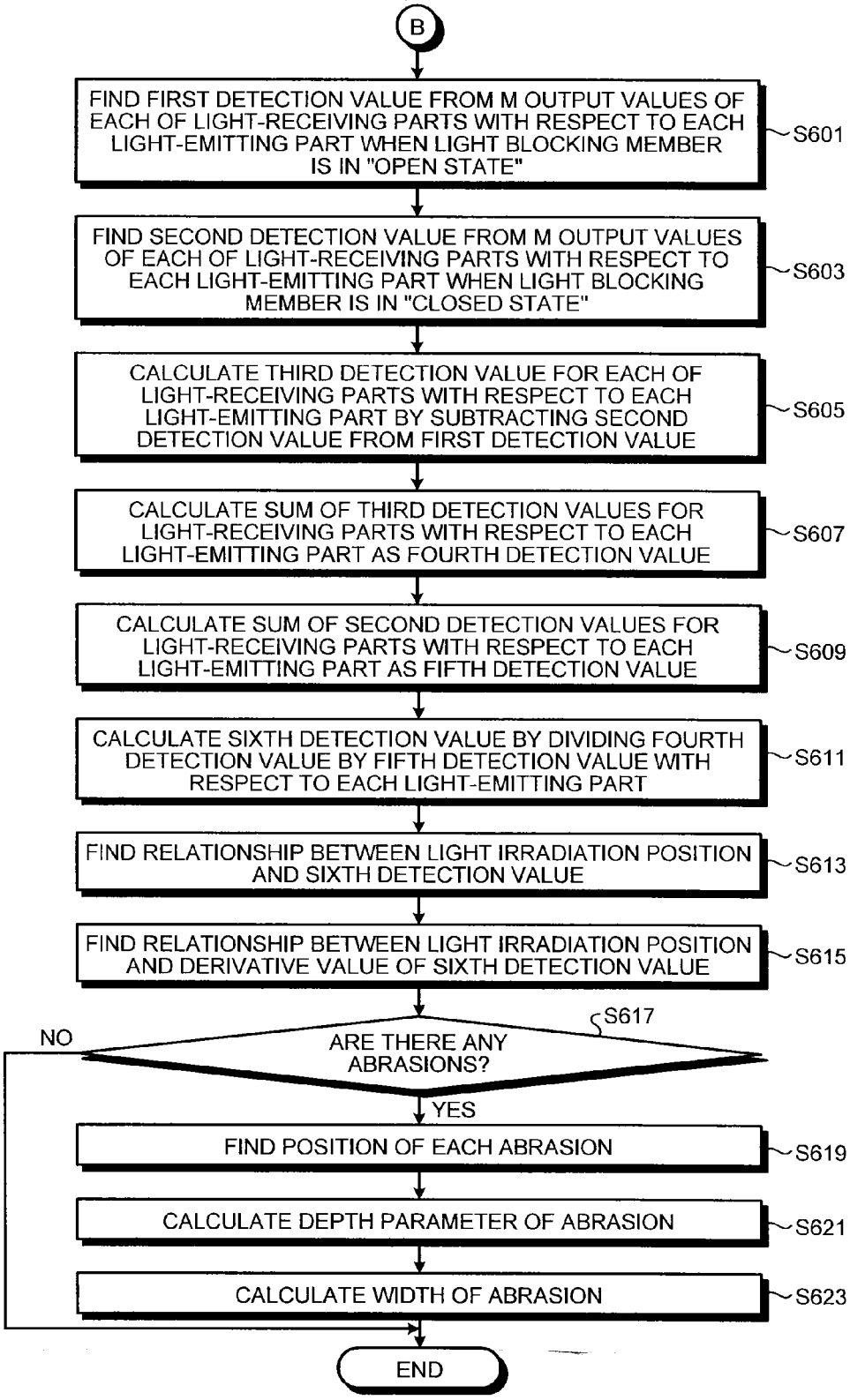
FIG. 24 is a (third) flowchart for explaining the surface-condition checking process.

Moreover, in the present embodiment, the process performed by the CPU of the printer control device 2090, which is indicated in the flowcharts shown in FIGS. 22 to 24, has been stored as a program in the ROM (a recording medium) of the printer control device 2090.

As explained above, the color printer 2000 according to the present embodiment includes the optical scanning device 2010, the four image forming stations, the intermediate transfer belt 2040, the secondary transfer roller 2042, the fixing device 2050, the reflective optical sensor 2245, the light blocking mechanism 100, the operation panel, and the printer control device 2090, etc.

The reflective optical sensor 2245 includes the substrate 45, the frame member 46, the twenty-eight light-emitting parts (E11 to E74) which are arranged along the y-axis direction and emit light toward the fixing belt 502, the seven illumination lenses (EL1 to EL7), the one light-receiving lens DL, the twenty-eight light-receiving parts (D1 to D28) which are arranged at equal spaces along the y-axis direction and receive light reflected by the fixing belt 502, and the apertured member 47, etc.

One illumination lens corresponds to multiple light-emitting parts; therefore, it is possible to simplify the structure of the lens member.

The light blocking mechanism 100 includes the light blocking member 100*a* and the drive unit 100*b* for moving the light blocking member 100*a* in the x-axis direction; the state of the light blocking member 100*a* can be alternatively selected from the "open state" and the "closed state".

The printer control device 2090 eliminates the influence of reflection by the apertured member 47 from an output signal of the reflective optical sensor 2245 obtained when the light blocking member 100*a* is in the "open state" on the basis of an output signal of the reflective optical sensor 2245 obtained when the light blocking member 100*a* is in the "closed state", and corrects variation in an emitting light amount among multiple light-emitting parts; therefore, it is possible to find the position of an abrasion on the fixing belt 502, a depth parameter of the abrasion, and the width of the abrasion with high accuracy.

Consequently, maintenance of the fixing belt 502 can be performed appropriately, and therefore reduction in image quality is suppressed, and the color printer 2000 can stably form excellent images.

Furthermore, the light blocking member 100*a* has heat resisting property, and blocks heat from the fixing belt 502 from being directly transmitted to the reflective optical sensor 2245 when the light blocking member 100*a* is in the "closed state"; therefore, the reflective optical sensor 2245 need not have heat resisting property. Consequently, it is possible to curb the high cost of the reflective optical sensor 2245.

Incidentally, in the embodiment described above, there is explained the case where the number of groups is seven; however, it is not limited to this.

Furthermore, in the embodiment described above, there is explained the case where the number of light-emitting parts included in one group is four; however, it is not limited to this.

Moreover, in the embodiment described above, there is explained the case where the number of light-emitting parts and the number of light-receiving parts are the same; however, they are not limited to this. The number of light-receiving parts can be fewer than the number of light-emitting parts. In this case, an electronic component such as an operational amplifier can be eliminated, and the cost can be reduced. Furthermore, a single component having a light-receiving surface can be used as light-receiving parts.

In short, the reflective optical sensor 2245 just has to include N (N≥1) light-emitting parts arranged in one direction and K (K≥1) light-receiving parts that receive a reflected light from the fixing belt 502.

Furthermore, in the above-described embodiment, the size of the illumination lenses can be increased so that the illumination lenses can double as the light-receiving lens.

Moreover, in the above-described embodiment, there is explained the case where in the surface-condition checking process, an output signal of the reflective optical sensor 2245 when the light blocking member 100*a* is in the "closed state" is acquired, and then an output signal of the reflective optical sensor 2245 when the light blocking member 100*a* is in the "open state" is acquired; however, the order of these processes is not limited to this. An output signal of the reflective optical sensor 2245 when the light blocking member 100*a* is in the "closed state" can be acquired after an output signal of the reflective optical sensor 2245 when the light blocking member 100*a* is in the "open state" is acquired.

Furthermore, in the above-described embodiment, there is explained the case where in the surface-condition checking process, twenty light-emitting parts in Groups 2 to 6 are used; however, light-emitting parts to be used are not limited to those in the groups.

Figure 33:
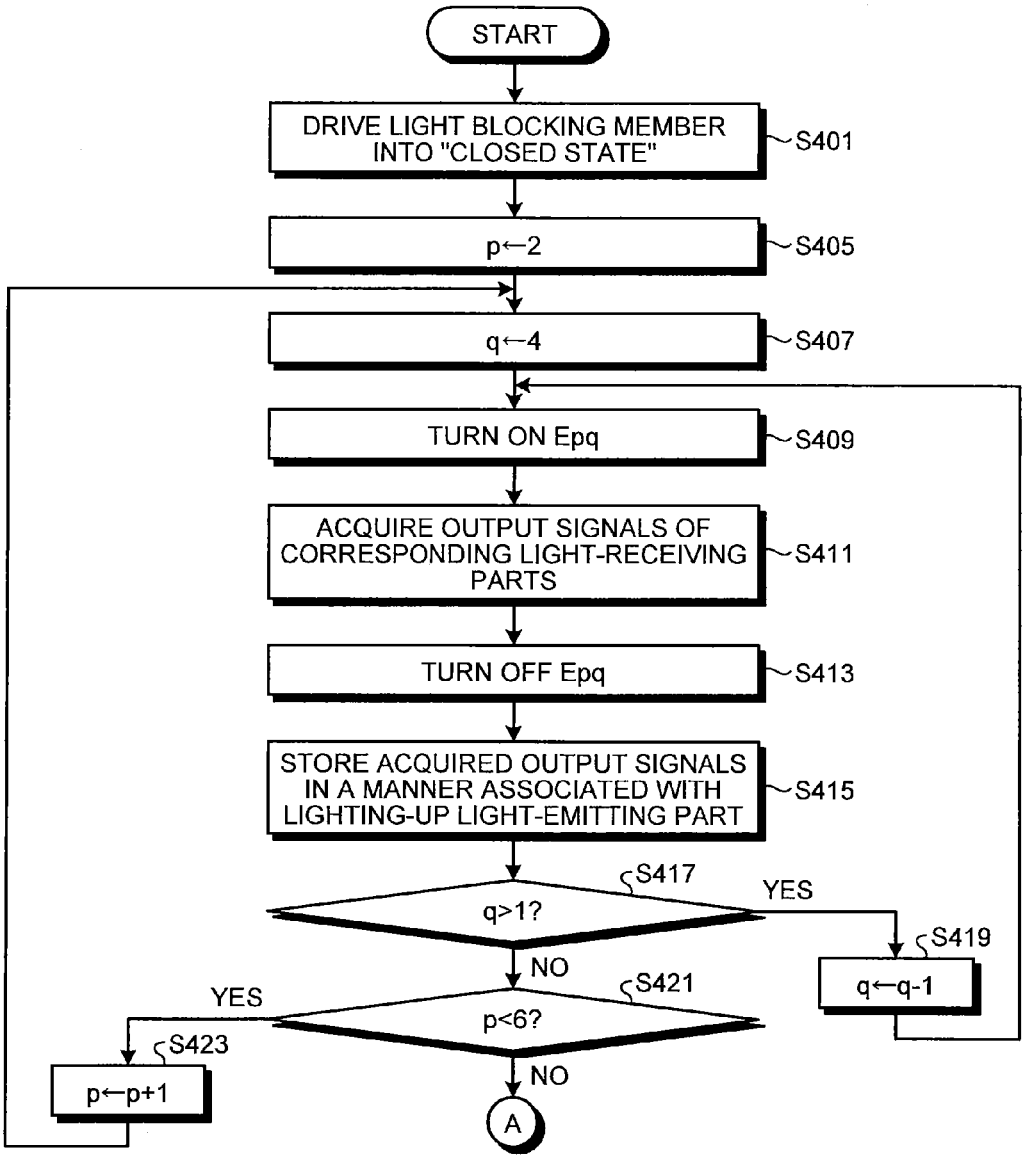
FIG. 33 is a flowchart for explaining modification example 1 of the surface-condition checking process.

Moreover, in the above-described surface-condition checking process according to the embodiment, there is explained the case where when the light blocking member 100*a* is in the "closed state", the processes at Steps S405 to S427 are repeated M times; however, the processes do not have to be repeated (see FIG. 33). In this case, an output value of each light-receiving part is the second detection value.

Figure 34:
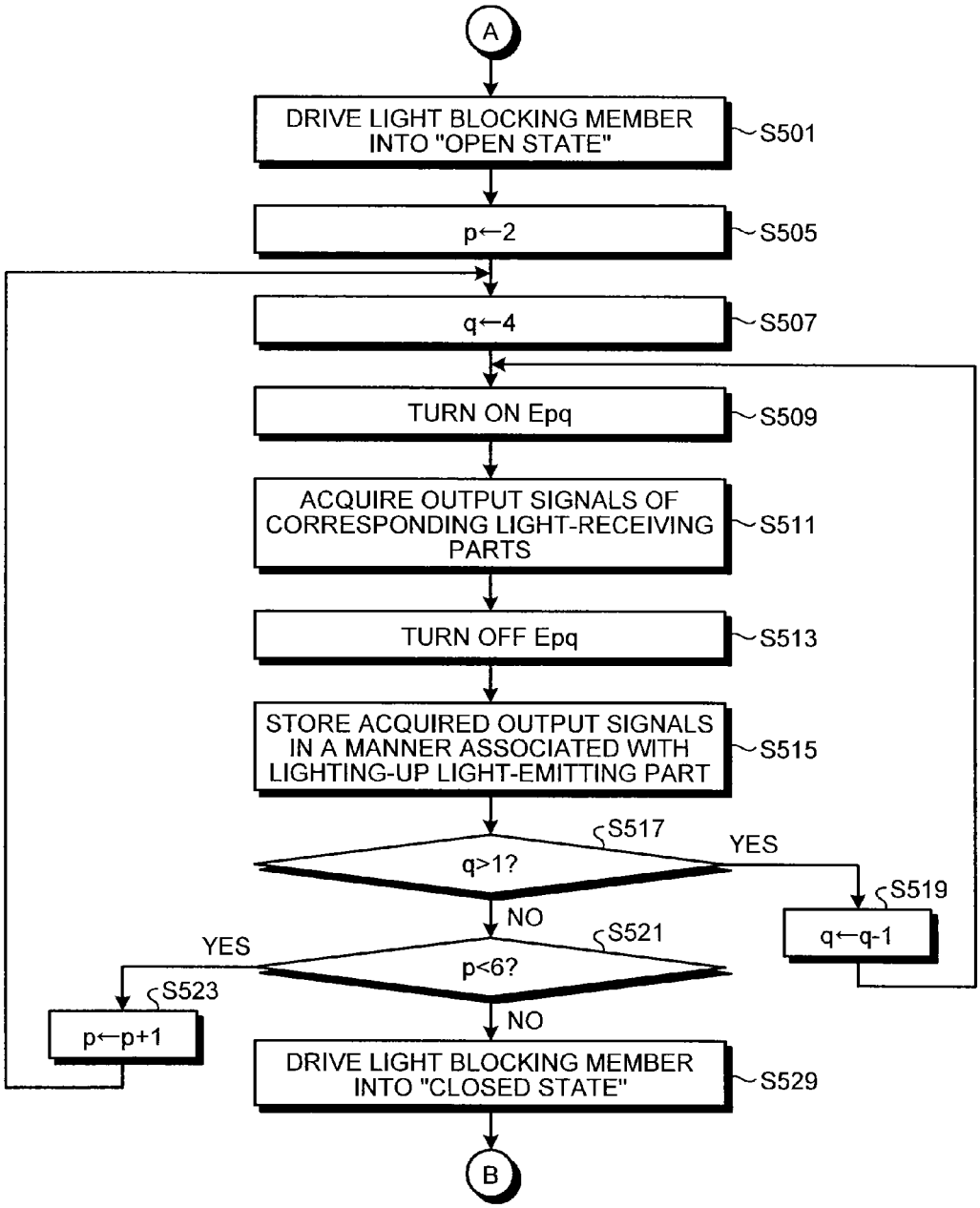
FIG. 34 is a flowchart for explaining modification example 2 of the surface-condition checking process.

Furthermore, in the above-described surface-condition checking process according to the embodiment, there is explained the case where when the light blocking member 100*a* is in the "open state", the processes at Steps S505 to S527 are repeated M times; however, the processes do not have to be repeated (see FIG. 34). In this case, an output value of each light-receiving part is the first detection value. Incidentally, as a matter of course, a flowchart shown in FIG. 33 and a flowchart shown in FIG. 34 can be combined.

Moreover, in the above-described surface-condition checking process according to the embodiment, if variation in an emitting light amount among multiple light-emitting parts is little, the fourth detection value can be directly set as a sixth detection value. In this case, the processes at Steps S609 and S611 need not be performed.

Furthermore, in the above-described embodiment, there is explained the case where the arrangement pitch of multiple light-receiving parts is 1 mm; however, it is not limited to this.

Moreover, in the above-described embodiment, there is explained the case where the formation pitch of multiple light spots is 1 mm; however, it is not limited to this.

Furthermore, in the above-described embodiment, there is explained the case where multiple illumination lenses and one light-receiving lens are integrated; however, these are not limited to be integrated.

Moreover, in the above-described embodiment, there is explained the case where multiple light-emitting parts are sequentially turned on individually; however, these are not limited to be turned on individually. For example, multiple light-emitting parts can be turned on at the same time. In this case, one light-receiving part corresponds to one light-emitting part.

Furthermore, in the above-described embodiment, a processing unit can be installed in the reflective optical sensor 2245, and the processing unit can perform at least some of the processes in the surface-condition checking process performed by the printer control device 2090.

Figure 35:
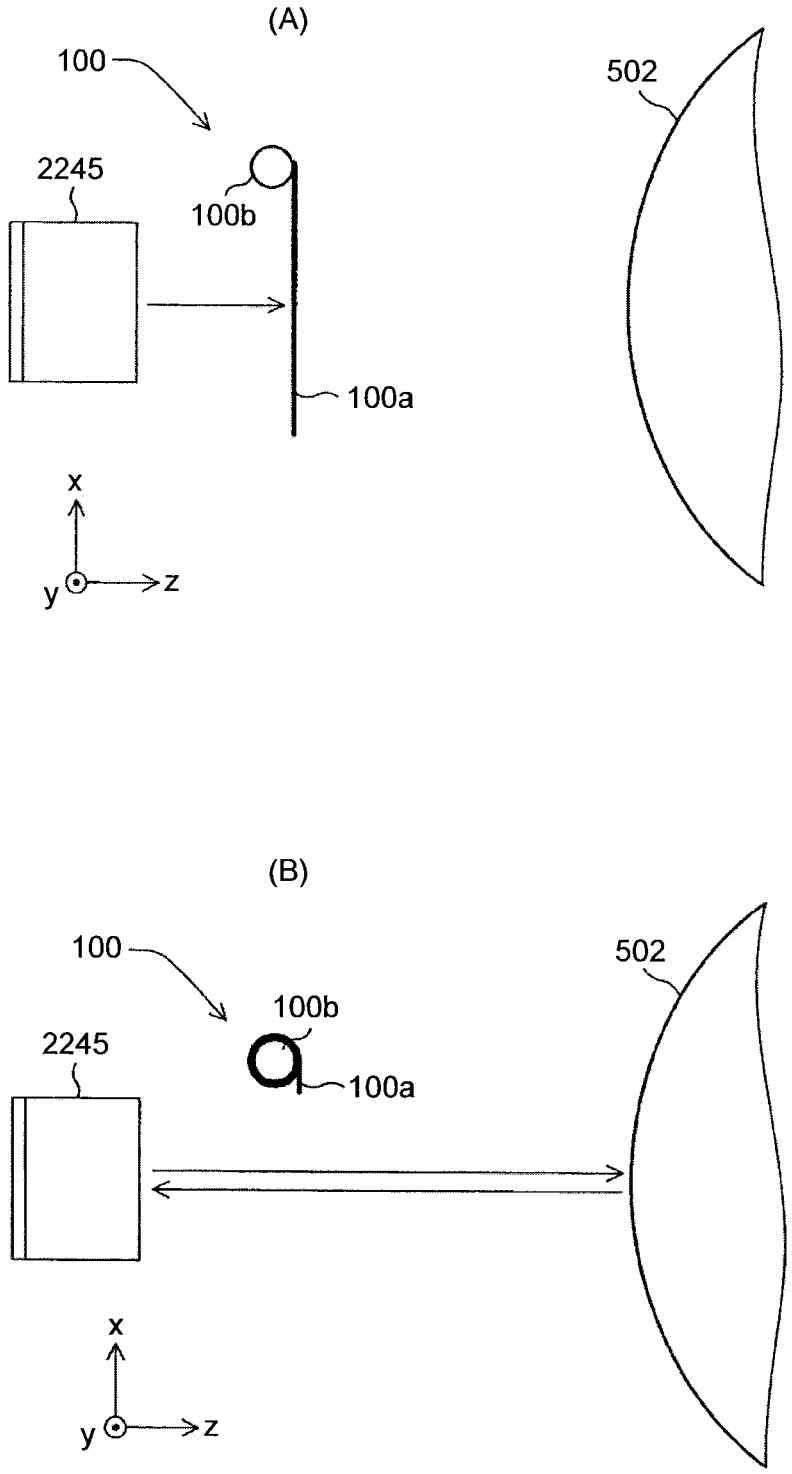
FIGS. 35(A) and 35(B) are diagrams for explaining modification of the light blocking mechanism.

Moreover, in the above-described embodiment, the drive unit 100*b* of the light blocking mechanism 100 can be configured to roll up the light blocking member 100*a*, for example, as shown in FIGS. 35(A) and 35(B), thereby putting the light blocking member 100*a* into the "open state". In this case, an installation space of the light blocking mechanism 100 can be reduced.

Furthermore, in the above-described embodiment, there is explained the case where the light blocking mechanism 700 includes the light blocking member 100*a* and the drive unit 100*b*; however, a configuration of the light blocking mechanism 100 is not limited to this. In short, the light blocking mechanism 100 only has to alternatively select from a first state where the light blocking mechanism 100 causes light which have been emitted from the reflective optical sensor 2245 and then reflected by the fixing belt 502 to enter the reflective optical sensor 2245 and a second state where the light blocking mechanism 100 causes the reflected light of the light emitted from the reflective optical sensor 2245 not to enter the reflective optical sensor 2245.

Moreover, in the above-described embodiment, there is explained the case where the length of the light blocking member 100*a* in the y-axis direction is equal to or slightly longer than the width (the length in the y-axis direction) of the fixing belt 502; however, it is not limited to this. For example, when miniaturization is given preference over the heat shielding effect, the length of the light blocking member 100*a* in the y-axis direction can be shorter than the width of the fixing belt 502. However, even in this case, it is preferable that the length of the light blocking member 100*a* in the y-axis direction is longer than the length of the reflective optical sensor 2245 in the y-axis direction.

Furthermore, in the above-described embodiment, the frame member 46 can be composed of four side plates.

Moreover, in the above-described embodiment, there is explained the case where multiple light-emitting parts are arranged along the y-axis direction; however, the arrangement of these is not limited to this, and multiple light-emitting parts can be arranged along a direction inclined to the y-axis direction.

Figure 36:
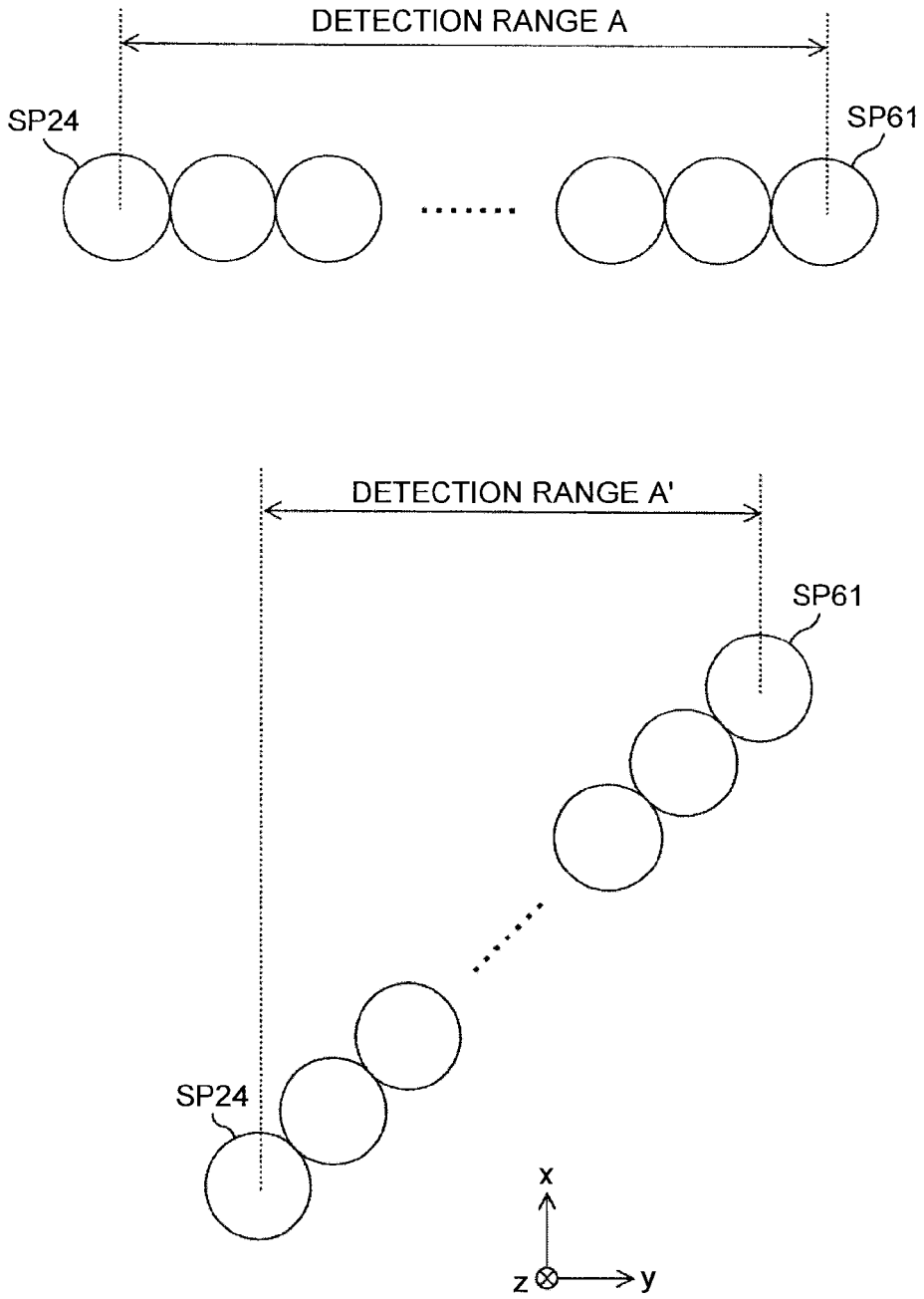
FIG. 36 is a diagram for explaining modification example of the installation posture of the reflective optical sensor.

For example, when a detection range in the case where multiple light-emitting parts are arranged along the y-axis direction is denoted by A, and a detection range in the case where multiple light-emitting parts are arranged along a direction inclined at 45° to the y-axis direction is denoted by A' as shown in FIG. 36, the detection range A' is $1/\sqrt{2}$ times smaller than the detection range A; however, the position resolution at the time of finding the position of an abrasion on the fixing belt 502 and conditions of the abrasion (a depth parameter of the abrasion and the width of the abrasion) can be increased.

Figure 37:
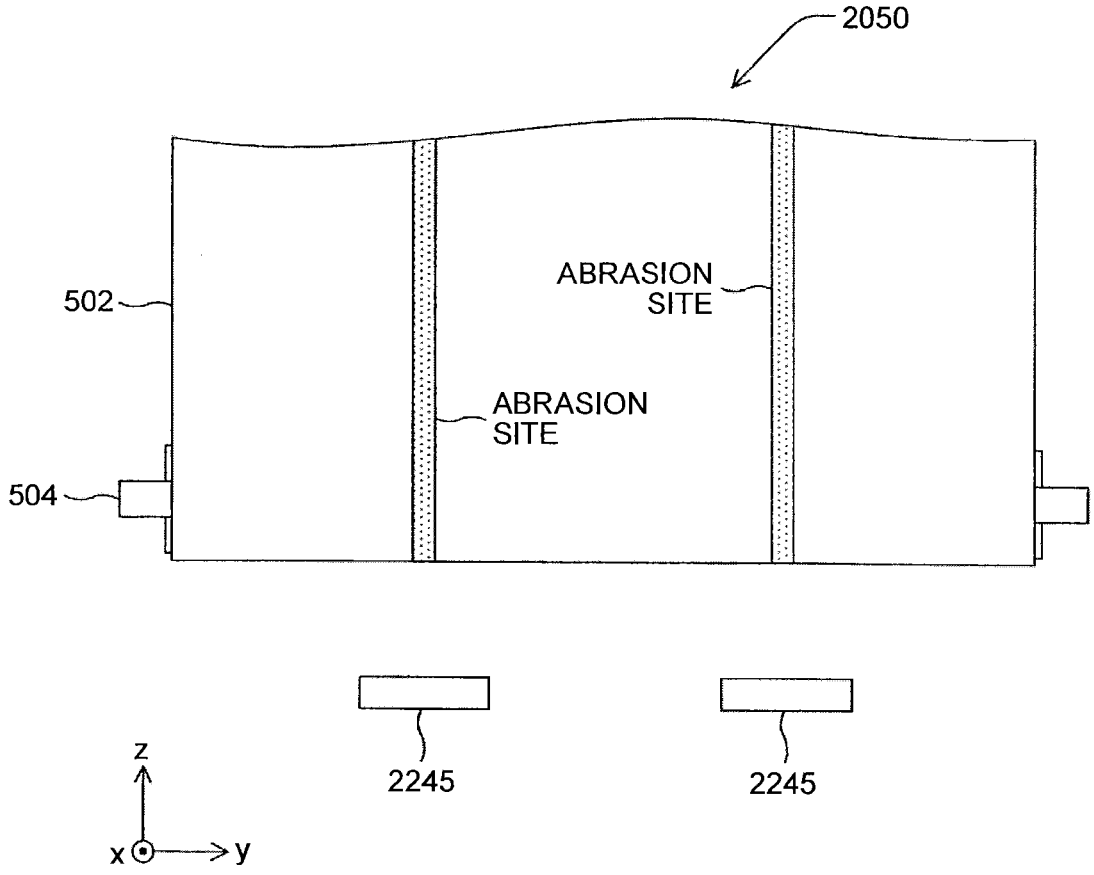
FIG. 37 is a diagram for explaining a case where two reflective optical sensors are installed.

Furthermore, in the above-described embodiment, there is explained the case where one reflective optical sensor 2245 is installed; however, the number of reflective optical sensors 2245 is not limited to this. For example, as shown in FIG. 37, an additional reflective optical sensor 2245 can be installed in the position opposed to the side abrasion site. Furthermore, when the color printer 2000 is available for many different sizes of recording sheets, and there are three or more abrasion sites, the reflective optical sensor 2245 can be installed with respect to each abrasion site.

Moreover, in the above-described embodiment, at least some of the processes performed by the CPU of the printer control device 2090 in accordance with the program can be configured to be performed by hardware, or all the processes can be performed by hardware.

Furthermore, in the above-described embodiment, there is explained the case where the position of an abrasion on the fixing belt 502, a depth parameter of the abrasion, and the width of the abrasion are detected by using the reflective optical sensor 2245; however, the detection is not limited to this, and at least any of the position of an abrasion on the fixing belt 502, a depth parameter of the abrasion, and the width of the abrasion can be detected.

Moreover, in the above-described embodiment, there is explained the case where longitudinal streak-like abrasions on the fixing belt 502 are detected by using the reflective optical sensor 2245; however, abrasions are not limited to this. For example, abrasions due to contact with the separation claw 506 and the temperature sensor can be detected by using the reflective optical sensor 2245.

While the width of a longitudinal streak-like abrasion is several hundred micrometers to several millimeters, the width of an abrasion due to contact with the separation claw 506 or the temperature sensor is tens of micrometers to several hundred micrometers. Furthermore, the occurrence positions of abrasions due to contact with the separation claw 506 and the temperature sensor are roughly fixed. Therefore, it is easy to distinguish between longitudinal streak-like abrasions and abrasions due to contact with the separation claw 506 and the temperature sensor.

Furthermore, a foreign substance (for example, toner) attached to the surface of the fixing belt 502 can be detected by using the reflective optical sensor 2245.

Moreover, a surface condition of a moving body other than the fixing belt 502 can be detected by using the reflective optical sensor 2245.

Furthermore, in the above-described embodiment, there is explained the case of a tandem-type multicolor printer that forms a full-color image by superimposing four different color images (black, cyan, magenta, and yellow images) on top of one another; however, an image forming apparatus is not limited to this type of printer. For example, it can be a multicolor printer that further uses auxiliary colors, and can be a printer that forms a monochromatic image.

Moreover, in the above-described embodiment, the color printer is explained as an example of an image forming apparatus; however, the image forming apparatus is not limited to this, and can be image forming apparatuses other than a printer, such as a copier, a facsimile apparatus, and a multifunction peripheral having functions of these.

Furthermore, in an apparatus other than the image forming apparatus, a surface condition of an object can be detected by using the reflective optical sensor 2245.

According to the image forming apparatus of the present invention, it is possible to suppress a decrease in image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a sensor configured to include a light-emitting part for emitting light to a moving body and a light-receiving part;

a light-incidence adjusting mechanism configured to be able to alternatively select from a first state where the light-incidence adjusting mechanism causes light which have been emitted from the sensor and then reflected by the moving body to enter the sensor and a second state where the light-incidence adjusting mechanism causes a reflected light of light emitted from the sensor not to enter the sensor; and a processing unit configured to cause the sensor to emit light, and correct output of the sensor when the light-incidence adjusting mechanism is in the first state on the basis of output of the sensor when the light-incidence adjusting mechanism is in the second state.

2. The image forming apparatus according to claim 1, wherein a portion of light emitted when the light-emitting part is turned on is scattered within the sensor and received by the light-receiving part.

3. The image forming apparatus according to claim 1, wherein the processing unit subtracts output of the sensor when the light-incidence adjusting mechanism is in the second state from output of the sensor when the light-incidence adjusting mechanism is in the first state.

4. The image forming apparatus according to claim 1, wherein the processing unit finds surface information of the moving body on the basis of the corrected output of the sensor.

5. The image forming apparatus according to claim 4, wherein the surface information of the moving body is abrasion information of a streak-like abrasion extending in a moving direction of the moving body.

6. The image forming apparatus according to claim 5, wherein the abrasion information is information on at least either one of the position of the abrasion and the depth of the abrasion.

7. The image forming apparatus according to claim 1, wherein the moving body is a fixing belt.

8. A sensing method using a sensor that includes a light-emitting part for emitting light to an object and a light-receiving part, a portion of the light emitted when the light-emitting part is turned on being scattered within the sensor and received by the light-receiving part, the sensing method comprising:

causing light which have been emitted from the sensor and then reflected by the object to enter the sensor and finding output of the sensor as a first output value;

causing the sensor to emit light and finding output of the sensor as a second output value, in a state where a reflected light of light emitted from the sensor does not enter the sensor;

correcting the first output value on the basis of the second output value; and finding surface information of the object on the basis of the corrected first output value.

9. A non-transitory computer-readable recording medium that contains a computer program used in an apparatus equipped with a sensor that includes a light-emitting part for emitting light to an object and a light-receiving part, a portion of the light emitted when the light-emitting part is turned on being scattered within the sensor and received by the light-receiving part, the program causing a computer for controlling the apparatus to execute:

causing light which have been emitted from the sensor and then reflected by the object to enter the sensor and finding output of the sensor as a first output value;

causing the sensor to emit light and finding output of the sensor as a second output value, in a state where a reflected light of light emitted from the sensor does not enter the sensor;

correcting the first output value on the basis of the second output value; and finding surface information of the object on the basis of the corrected first output value.

* * * * *